US006205918B1

(12) United States Patent
Takahashi et al.

(10) Patent No.: US 6,205,918 B1
(45) Date of Patent: Mar. 27, 2001

(54) STENCIL PRINTER

(75) Inventors: Mituru Takahashi, Shiroishi; Hideaki Matsuda, Natori, both of (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 0 days.

(21) Appl. No.: 09/274,324

(22) Filed: Mar. 23, 1999

(30) Foreign Application Priority Data

Mar. 30, 1998 (JP) ..... 10-083967

(51) Int. Cl.[7] ..... B41L 13/00
(52) U.S. Cl. ..... 101/118; 101/115; 101/116
(58) Field of Search ..... 101/114, 115, 101/116, 118, 232, 233, 234, 181, 183, 184; 271/10.02, 10.03, 258.01, 258.02, 259, 265.01, 265.02

(56) References Cited

U.S. PATENT DOCUMENTS

| | | | | |
|---|---|---|---|---|
| 4,939,676 | * | 7/1990 | Worsely et al. | 271/258 |
| 5,048,416 | * | 9/1991 | Iijima | 101/115 |
| 5,113,757 | * | 5/1992 | Spencer | 101/115 |
| 5,375,516 | * | 12/1994 | Hasegawa | 101/116 |
| 5,464,204 | * | 11/1995 | Suzuki | 271/110 |
| 5,890,708 | * | 4/1999 | Song | 271/10.03 |

FOREIGN PATENT DOCUMENTS

| | | |
|---|---|---|
| 64-18682 | 1/1989 | (JP) . |
| 5-229243 | 9/1993 | (JP) . |
| 6-32038 | 2/1994 | (JP) . |
| 7-17121 | 1/1995 | (JP) . |

OTHER PUBLICATIONS

U.S. application No. 09/274,324, filed Mar. 3, 2000, pending.
U.S. application No. 09/604575, files Jun. 27, 2000, pending.

* cited by examiner

*Primary Examiner*—Ren Yan
(74) *Attorney, Agent, or Firm*—Oblon, Spivak, McClelland, Maier & Neustadt, P.C.

(57) ABSTRACT

A stencil printer includes a plurality of ink drums spaced from each other in the direction of paper conveyance and each having a respective master wrapped therearound. An upstream ink drum and pressing means movable into and out of contact with the upstream ink drum define an upstream print position. A downstream ink drum and pressing means movable into and out of contact with the downstream ink drum define a downstream print position. An intermediate conveyor is located between the upstream print position and the downstream print position for conveying a paper carrying an image printed at the upstream print position toward the downstream print position. A distance which the paper moves from the upstream print position to the downstream print position is longer than a distance between the upstream print position and the downstream print position. Defective printing is reduced even when the peripheral speed of the upstream ink drum and that of the downstream ink drum are different from each other.

18 Claims, 17 Drawing Sheets

STENCIL PRINTER

BACKGROUND OF THE INVENTION

The present invention relates to a stencil printer of the type including a plurality of ink drums.

Japanese Patent Laid-Open Publication No. 7-17121, for example, teaches a stencil printer capable of printing a multicolor image on a paper by conveying the paper only once. The stencil printer taught in this document includes a plurality of ink drums spaced from each other in a direction of paper conveyance. A particular master is wrapped around each of the ink drums. An intermediate conveyor is positioned between the ink drums for conveying a paper carrying an image printed by an upstream ink drum toward a downstream ink drum. The intermediate conveyor conveys the paper at a constant speed while each ink drum rotate at a constant peripheral speed in synchronism with a paper feed timing. In this configuration, the paper coincides with an ink image formed on each drum at a print position where the ink drum is located.

A problem arises in the stencil printer of the type described when the size (overall length) of a paper is greater than -the distance between an upstream print position where the upstream ink drum is located and a downstream print position where the downstream ink drum is located. The drums are driven by a motor or similar drive source via a drive transmission mechanism including gears and belts. The peripheral speeds of the ink drums are not always equal to each other due to the expansion or contraction of the belts or various kinds of irregularities including the dimensional errors of the gears and those of the ink drums. When the peripheral speeds of the ink drums are different from each other, it is likely that the paper is pulled or slackened in the direction of paper conveyance. For example, assume that the peripheral speed of the downstream ink drum is higher than the peripheral speed of the upstream ink drum. Then, so long as the overall length of the paper is smaller than the distance between the two print positions, the leading edge of the paper successfully reaches the downstream print position after the trailing edge of the paper has moved away from the upstream print position. The paper is therefore conveyed by the peripheral speed of the downstream ink drum. However, if the overall length of the paper is greater than the above distance, then the paper extends over both the upstream print position and downstream print position. As a result, the paper is pulled in the direction of paper conveyance due to the difference between the peripheral speeds of the two ink drums while printing is under way at the upstream print position. This is apt to cause an image to be dislocated relative to the paper at the upstream print position in the direction of paper conveyance or relative to an image to be printed at the downstream print position, resulting in a defective printing.

On the other hand, when the peripheral speed of the downstream ink drum is lower than the peripheral speed of the upstream ink drum, the paper slackens on the intermediate conveyor. This also results in a defective printing although the deviation of the image printed at the upstream print position relative to the image printed at the downstream print position will be reduced, compared to the above condition.

Technologies relating to the present invention are also disclosed in, e.g., Japanese Patent Laid-Open Publication Nos. 64-18682, 5-229243, 6-32038 and 10-315601 (corresponding to U.S. patent application Ser. No. 09/079,287 filed May 15, 1998), and Japanese Patent Application Nos. 9-321702 and 10-167322 (corresponding to the pending U.S. patent application Ser. No. 09/164,372 filed Oct. 1, 1998).

SUMMARY OF THE INVENTION

It is therefore an object of the present invention to provide a stencil printer of the type including a plurality of ink drums and capable of reducing defective printing even when the peripheral speeds of the ink drums are different from each other.

A stencil printer of the present invention includes a plurality of ink drums spaced from each other in a direction of paper conveyance, and each having a respective master wrapped therearound and fed with ink from an ink feeding device to an inner periphery thereof. A plurality of pressing devices each are movable toward and away from associated one of the ink drums. An intermediate conveyor is provided for conveying a paper on which an image is printed at an upstream print position where an upstream ink drum in the direction of paper conveyance and associated pressing device nip the paper to a downstream print position where a downstream ink drum and associated pressing device nip the paper. The intermediate conveyor is positioned between the upstream ink drum and the downstream ink drum. A paper conveyance distance which the paper moves while being conveyed from the upstream print position to the downstream print position is longer than a distance between the upstream print position and the downstream print position.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
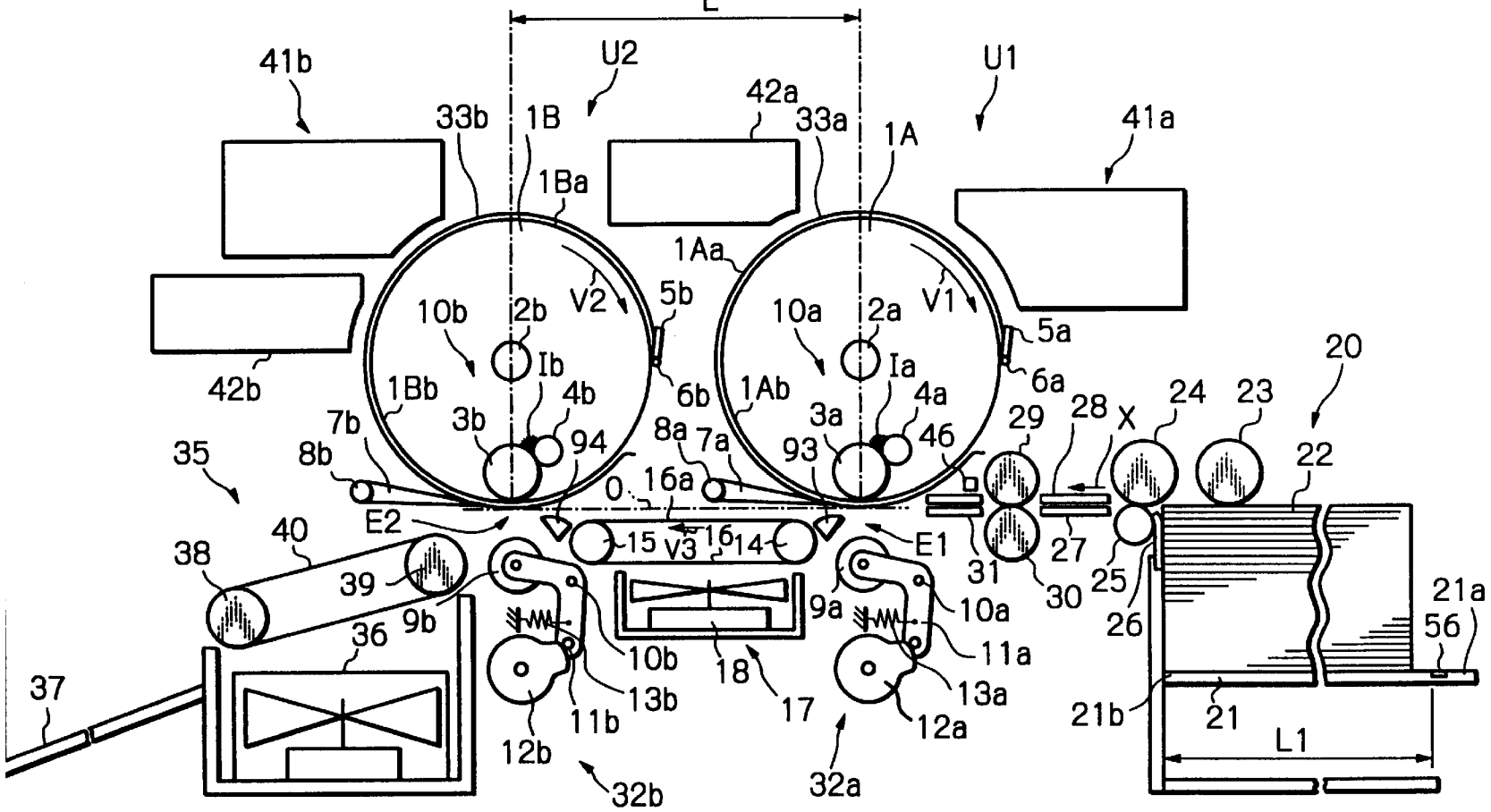
FIG. 1 shows the general construction of a stencil printer in accordance with the present invention.

First, the general construction and basic operation of the stencil printer in accordance with the present invention will be described. As shown in FIG. 1, the stencil printer includes two ink drums 1A and 1B respectively located at the upstream side and downstream side in a direction X in which a paper or similar recording medium 22 is conveyed. With the two ink drums 1A and 1B, the printer is capable of producing multicolor printings (bicolor printings in this case). The ink drums 1A and 1B are substantially identical in configuration and function. Substantially identical ink feeding means, master making devices, master discharging devices and so forth are arranged around the ink drums 1A and 1B, as will be described specifically later. Such identical constituents around the drums 1A and 1B are designated by like reference numerals and simply distinguished from each other by suffixes A and B or a and b. When one of the identical constituents around the ink drums A and B is described in detail, a detailed description of the other constituent will not be made in order to avoid redundancy.

The printer is a conventional thermosensitive digital master making type printer. A master 33*a* is wrapped around the outer periphery 1A*a* of the ink drum 1A. A master making device 41*a* is positioned above and at the right-hand side of the ink drum 1A for making the master 33*a*. Paper feeding means 20 is positioned below the master making device 41*a* for feeding papers 22 from a paper tray 21 one by one. A master discharging device 42*a* is located above and at the left-hand side of the ink drum 1A for peeling off a used master, not shown, existing on the ink drum 1A and discharging it. A pressing device or pressing means 32*a* is arranged below this ink drum 1A for pressing the paper 22 being conveyed against the master 33*a* wrapped around the ink drum 1A. An air knife or separating means 7*a* separates the paper or printing 22 on which an image has been printed at an upstream print position E1 between the ink drum 1A and the pressing device 32*a*. The ink drum 1A, master making device 41*a*, paper feeding means 20, master discharging device 42*a*, pressing device 32*a* and air knife 7*a* constitute a first unit U1.

Likewise, a master 33*b* is wrapped around the outer periphery 1B*a* of the ink drum 1B. A master making device 41*b* is positioned above and at the right-hand side of the ink drum 1B for making the master 33*b*. A master discharging device 42*b* is located above and at the left-hand side of the ink drum 1B for peeling off a used master, not shown, existing on the ink drum 1B and discharging it. A pressing device or pressing means 32*b* is arranged below the ink drum 1B for pressing the paper 22 being conveyed against the master 33*b* wrapped around the ink drum 1B. An air knife or separating means 7*b* separates the paper or printing 22 on which an image has been printed at a downstream print position E2 between the ink drum 1B and the pressing device 32*b*. The ink drum 1B, master making device 41*b*, master discharging device 42*b*, pressing device 32*b* and air knife 7*b* constitute a second unit U2.

An intermediate conveyor (simply conveyor hereinafter) 17 conveys the printing 22 coming out of the upstream print position E1 toward the downstream print position E2. A paper discharging device 35 is arranged below the master discharging device 42*b* for driving the printing 22 out of the printer to a tray 37.

Both the ink drums 1A and 1B may be used to print images in the same color as each other. Alternatively, one of the ink drums 1A and 1B may be fixedly assigned to a single document, i.e., a single master, in which case the other ink drum will be assigned to variable document information.

A document reading section or scanner, not shown, for reading a document and an operation panel 70 (see FIG. 2) are positioned above the master making devices 41*a* and 41*b* and master discharging device 42*a*.

The ink drum 1A has a conventional porous, hollow cylindrical configuration and is rotatably mounted on a shaft 2*a*. A drum motor or drive source which will be described causes the ink drum 1A to rotate in a direction indicated by an arrow. An openable damper 5*a* is mounted on the outer periphery of the ink drum 1A and extends in parallel to the axis of the drum 1A. The camper 5*a* clamps the leading edge of the master 33*a* when closed. Specifically, opening and closing means, not shown, is located at a suitable position around the ink drum 1A and causes the damper 5*a* to open and close at a preselected position. Ink feeding means 10*a* is arranged within the ink drum 1A for feeding ink from the inner periphery 1A*b* to the outer periphery 1A*a* of the ink drum 1A. In accordance with the present invention, the ink feeding means 10*a* and ink feeding means 10*b* arranged within the ink drums 1A and 1B feed magenta ink and black ink, respectively. Magenta and black will sometimes be referred to as a first color and a second color, respectively.

In accordance with the present invention, use is made of a stencil made up of a film of polyester or similar thermoplastic resin and a porous support adhered to the film and implemented by, e.g., Japanese paper. If desired, the stencil may consist only of an extremely thin, thermoplastic resin film.

Figure 2:
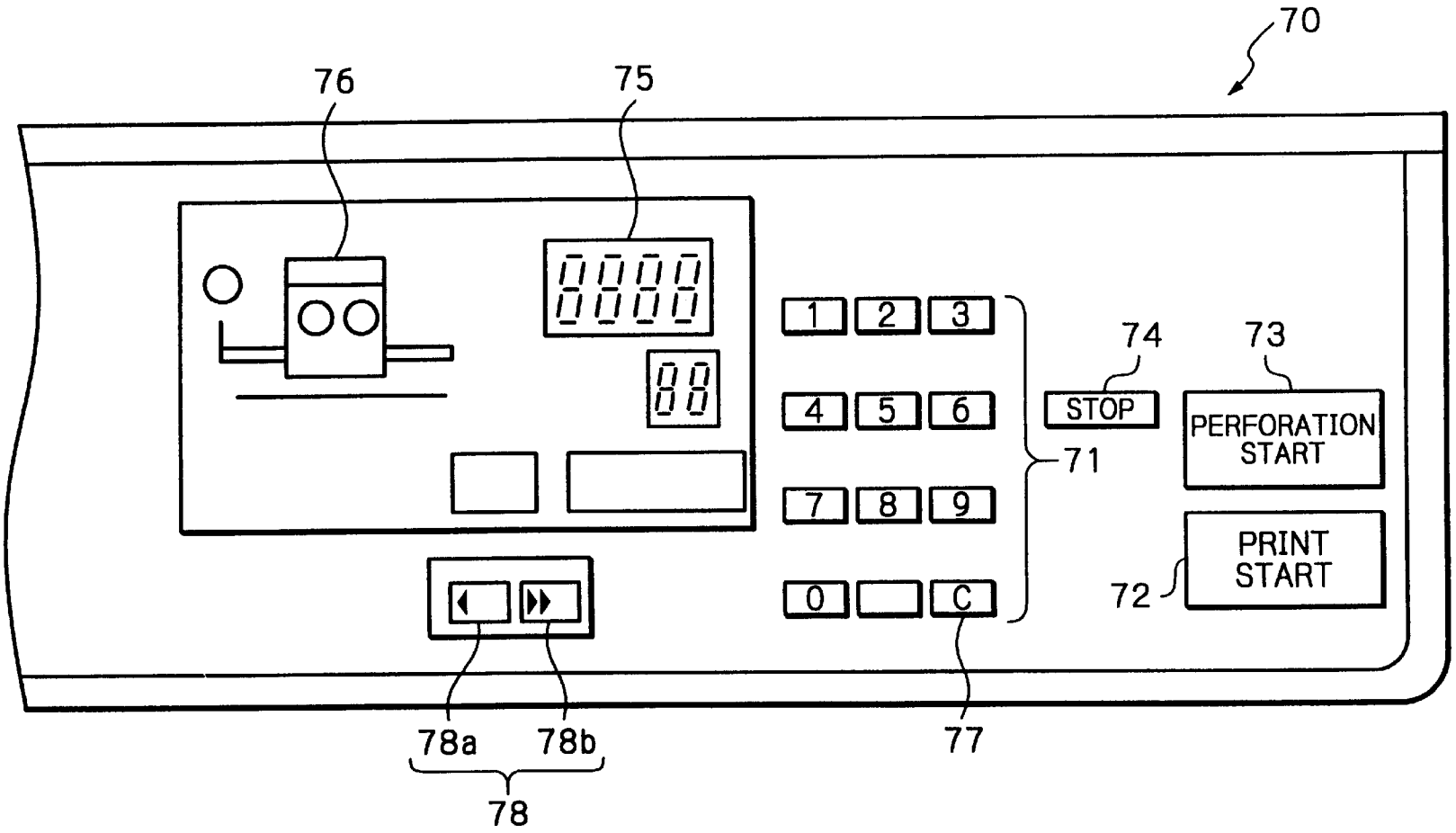
FIG. 2 is a fragmentary plan view showing a specific configuration of an operation panel included in the stencil printer.

The operator of the printer sets a desired document on a tray included in the document reading section and then presses a perforation start key 73 (see FIG. 2). In response, the printer starts a master making operation with both of the ink drums 1A and 1B. Specifically, the ink drum 1A is rotated in the direction (counterclockwise) opposite to the direction indicated by the arrow. As a result, the used master existing on the ink drum 1A is sequentially peeled off and conveyed to a waste master box, not shown, associated with the drum 1A.

The document reading section reads the document in parallel with the above master discharging operation by use of a conventional reduction type reading system. An image optically read out of the document is incident to a CCD (Charge Coupled Device) image sensor or similar photoelectric transducer and transformed to an electric signal thereby. The electric signal output form the transducer is sent to an analog-to-digital (AD) conversion board, not shown, and converted to a digital image signal thereby.

The document reading section includes a construction having various functions for color separation essential with multicolor printing. Such a construction may be implemented by, e.g., a filter unit taught in Laid-Open Publication No. 64-18682 mentioned earlier and including a plurality of replaceable color filters. The filter unit is positioned on an optical path between a group of mirrors and a lens not shown.

While the document reading section reads the document, the master making devices 41*a* and 41*b* each perforate a respective stencil in accordance with the digital image signal output from the above section while conveying the perforated part of the stencil. Specifically, the master making device 41*a* includes a flat thermal head, a platen roller pressed against the thermal head and a roller pair, although not shown specifically. The platen roller and roller pair cooperate to convey the perforated part of the stencil to the downstream side along a master transport path. The thermal head has a number of fine heating elements, not shown, arranged in an array in the main scanning direction of the head. The heating elements are selectively energized in accordance with the digital image data subjected to various kinds of processing by the A/D conversion board and a master making control board, not shown, following the A/D conversion board. Consequently, the thermoplastic resin film of the stencil contacting the thermal head is selectively perforated by heat in a pattern represented by the image signal.

The above roller pair conveys the leading edge of the perforated stencil or master 33*a* toward the outer periphery of the ink drum 1A. A guide plate, not shown, steers the leading edge of the master 33*a* toward the damper 5*a* held in its open position, i.e., causes it to hang down toward the damper 5*a*. At this instant, the ink drum 1A from which the used master has already been removed is held stationary in a stand-by position. A roller pair identical with the above roller pair conveys the leading edge of the master 33*b* toward the outer periphery of the ink drum 1B while a guide plate, not shown, guides the master 33*b* in the substantially horizontal direction. At this time, the ink drum 1B is held stationary at a stand-by position where a damper 5*b* mounted on the drum 1B is opened and located on substantially the top of the drum 1B, as seen in FIG. 1. The master 33*b* is therefore inserted into the damper 5*b*.

As soon as the damper 5*a* clamps the leading edge of the master 33*a* at a preselected timing, the ink drum 1A is caused to rotate in the clockwise direction while sequentially wrapping the master 33 therearound. Cutting means, not shown, is included in the master making device 41*a* and made up of, e.g., a movable edge and a fixed edge. The cutting means cuts the trailing edge of the master 33*a* at a preselected length. When the master 33*a* is fully wrapped around the ink drum 1A, the master making and feeding operation ends.

After the masters 33*a* and 33*b* have been fully wrapped around the ink drums 1A and 1B, respectively, a trial printing and actual printing operation begins, as follows. First, the paper tray 21 is elevated to a level where the top paper 22 on the paper tray 21 contacts a pick-up roller 23. In this condition, the pick-up roller 23 is rotated to pay out the top paper 21. A pair of separator rollers 24 and 25 and a separator plate 26 cooperate to separate the top paper 22 from the other papers underlying it. The paper 22 is conveyed in the direction of paper conveyance X toward a pair of registration rollers 29 and 30 while being guided by an upper and a lower guide 28 and 27, respectively. The leading edge of the paper 22 abuts against a portion of the registration rollers 29 and 30 just short of a nip and is caused to bend along the upper guide plate 28.

On the start of the printing operation, the ink drum 1A located at the upstream side in the direction of paper conveyance X starts rotating at a speed assigned to the printing operation. An ink roller 3*a* and a doctor roller 4*a* are disposed in the ink drum 1A and form an ink well la therebetween. An ink distributor, not shown, feeds magenta ink to the ink well la. The ink roller 3*a* and doctor roller 4*a* in rotation knead and extend the magenta ink while causing it to uniformly deposit on the inner periphery 1A*b* of the ink drum 1A. Specifically, the ink roller 3*a* rotates in contact with the inner periphery 1A*b* of the ink drum 1A in the same direction and at the same peripheral speed as the ink drum 1A, feeding the ink to the inner periphery 1A*b*. Ink sensing means shown in FIG. 2 of Laid-Open Publication No. 5-229243 mentioned earlier senses the amount of ink remaining in the ink well la. The ink distributor replenishes the magenta ink when it is short, as determined by the ink sensing means.

The pressing device 32*a* includes the ink roller 3*a* and a press roller 9*a*, a bracket 11*a*, a tension spring 13*a*, and a cam 12*a*. The press roller or pressing means 9*a* presses the paper 22 being conveyed against the ink drum 1A so as to form an image on the paper 22. The press roller 9*a* is rotatably supported by one end of the bracket 11*a* and movable into and out of contact with the outer periphery of the ink drum 1A. The tension spring 13*a* is anchored to the other end of the bracket 11*a* and holds it in contact with the contour of the cam 12*a*. At the same time, the press roller 9*a* tends to contact the ink drum 1A due to the action of the tension spring 13*a*.

A drum driveline 89 (see FIG. 3) rotates the cam 12*a* in synchronism with the timing for feeding the paper 22 from the paper feeding means 20 and the rotation of the ink drum 1A. When no papers 22 are fed from the paper feeding means 20, a larger diameter portion forming a part of the cam 12*a* faces the end of the bracket 11*a* adjoining it. When the paper 22 is fed from the paper feeding means 20, the cam 12*a* is rotated such that a smaller diameter portion forming the other part of the cam 12*a* faces the above end of the bracket 11*a*, causing the press roller 9*a* to angularly move clockwise, as viewed in FIG. 1.

When the registration rollers 29 and 30 convey the paper 22 to the upstream print position E1 in synchronism with the rotation of the ink drum 1A, the press roller 9*a* positioned below the ink drum 1A is angularly moved upward so as to press the paper 22 against the master 33*a* wrapped around the drum 1A. The master 33*a* is therefore brought into close contact with the outer periphery 1A*a* of the ink drum 1A due to the viscosity of ink penetrating through the porous portion of the drum 1A. Further, the ink penetrates through the perforation pattern of the master 33*a* and is transferred to the paper 22. Consequently, an image is formed on the paper 22 in the first color.

When the leading edge of the paper 22 carrying the image of the first color approaches the edge of the air knife 7*a*, the air knife 7*a* is caused to pivot about a shaft 8*a* toward the outer periphery of the ink drum 1A in synchronism with the rotation of the drum 1A. Then, compressed air is fed from an air pressure source, not shown, to the air knife 7*a* and sent from the edge of the air knife 7*a*. The compressed air separates the leading edge of the paper 22 from the ink drum 1A. The conveyor 17 conveys the paper 22 separated from the ink drum 1A to the downstream side in the direction of paper conveyance X.

The conveyor 17 includes a drive roller 15, a driven roller 14, a porous belt 16 passed over the two rollers 15 and 14, and a suction fan 18. Control means 34 (see FIG. 3) causes, via a conveyor driveline 88 (see FIG. 3), the conveying surface 16*a* of the belt 16 to move at a peripheral speed or conveying speed V3 substantially equal to peripheral speeds or conveying speeds V1 and V2 at which the ink drums 1A and 1B, respectively, rotate. The belt 16 turns in the counterclockwise direction in FIG. 1. The suction fan 18 retains the paper 22 being conveyed by the belt 16 on the conveying surface 16*a* of the belt 16 by suction. As a result, the paper 22 is conveyed by the belt 16 toward the downstream print position E2 while being surely held on the belt 16.

The ink drum 1B is located downstream of the ink drum 1A in the direction of paper conveyance X and assigned to the second color. The ink drum 1B is caused to start rotating in synchronism with the ink drum 1A at substantially the same peripheral speed as the ink drum 1A in the direction indicated by the arrow in FIG. 1 (clockwise). An ink roller 3*b* disposed in the ink drum 1B rotates in contact with the inner periphery 1B*b* of the drum 1B at the same peripheral speed as the drum 1B. The ink roller 3*b* feeds ink of the second color to the inner periphery of the ink drum 1B in exactly the same manner as the ink roller 3*a* disposed in the ink drum 1A.

When the paper 22 being conveyed by the belt 16 reaches the downstream print position E2, the press roller 9*b* positioned below the ink drum 1B is angularly moved upward so as to press the paper 22 against the master 33*b* wrapped around the drum 1B. The master 33*b* is therefore brought into close contact with the outer periphery 1B*a* of the ink drum 1B due to the viscosity of ink penetrating through the porous portion of the drum 1B. Further, the ink penetrates through the perforation pattern of the master 33*b* and is transferred to the paper 22. Consequently, an image is formed on the paper 22 in the second color in register with the image of the first color existing on the paper 22.

When the leading edge of the paper 22 carrying the composite or bicolor image approaches the edge of the air knife 7*b*, the air knife 7*b* is caused to pivot about a shaft 8*b* toward the outer periphery of the ink drum 1B in synchronism with the rotation of the drum 1B. Then, compressed air is fed from the air pressure source to the air knife 7*b* and sent from the edge of the air knife 7*b*. The compressed air separates the leading edge of the paper 22 from the ink drum 1B. The paper discharging device 35 conveys the paper 22 separated from the ink drum 1B further downward to the tray 37 in the direction of paper conveyance X.

The paper discharging device 35 includes a drive roller 38, a driven roller 39, a porous belt 40 passed over the two rollers 38 and 39, and a suction fan 36. The belt 40 is driven in synchronism with the rotation of the ink drum 1B at a peripheral speed at least equal to the peripheral speed of the drum 1B. The suction fan 36 retains the paper 22 on the belt 40 by suction. The belt 40 turns in the counterclockwise direction, as viewed in FIG. 1, so as to convey the paper or trial printing 22 to the tray 37. If the trial printing is acceptable, the operator inputs a desired number of printings on numeral keys 71 arranged on the operation panel 70, FIG. 2, and then presses a print start key 72 also positioned on the panel 70. In response, the printer repeats the above paper feeding step, printing step and paper discharging step a number of times corresponding to the desired number of printings.

A preferred embodiment of the stencil printer in accordance with the present invention will be described hereinafter. As shown in FIG. 1, the upstream print position E1 and downstream print position E2 are positioned substantially beneath the axes of rotation of the ink drums 1A and 1B, respectively. Therefore, in the illustrative embodiment, a distance L between the center of the print position E1 and that of the print position E2 is substantially equal to the distance between the axis of the ink drum 1A and that of the ink drum 1B.

The ink drums 1A and 1B each include a porous portion capable of accommodating the length of the paper 22 of size A3 (Japanese Industrial Standard) conveyed in a vertical position. In the illustrative embodiment, the distance L between the print positions E1 and E2 is smaller than the circumferential length of the porous portion of each of the drums 1A and 1B. That is, the distance L is smaller than the longitudinal dimension of the paper 22 of size A3.

Figure 4:
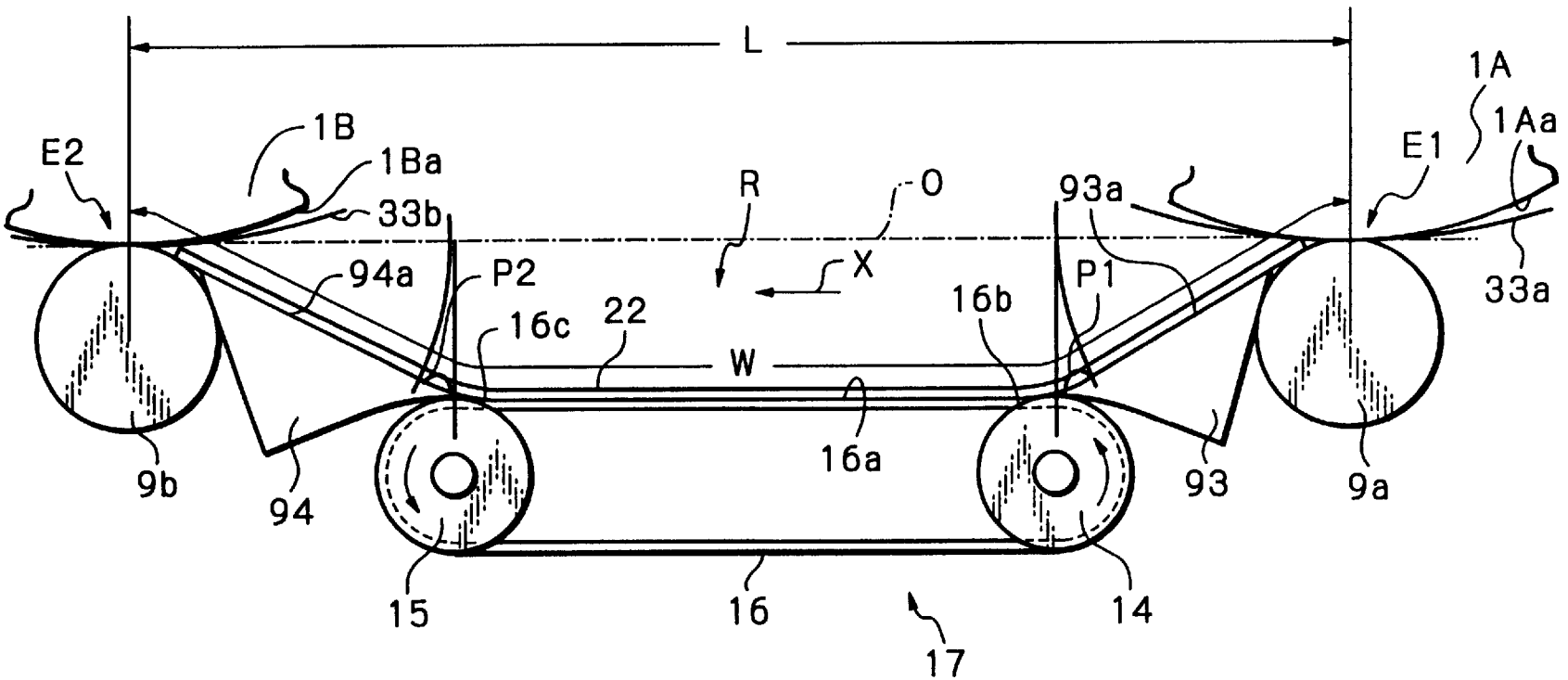
FIG. 4 is a fragmentary enlarged front view showing an intermediate conveyor representative of an embodiment of the present invention.

Specifically, as shown in FIG. 4, the conveying surface 16*a* of the belt 16 has an upstream end 16*b* and a downstream end 16*c* adjoining the upstream print position E1 and downstream print position E2, respectively. The upstream end 16*b* and downstream end 16*c* are positioned below an imaginary line 0 connecting the print positions E1 and E2 at the shortest distance. Stationary guide members 93 and 94 are respectively positioned between the print position E1 and the upstream end 16*b* of the belt 16 and between the downstream end 16*c* of the belt 16 and the print position E2.

The intermediate conveyor 17 is arranged in the printer such that the conveying surface 16*a* is parallel to and positioned below the line 0. The guide member 93 adjoins the press roller 9*a* and upstream end 16*b* and has a flat top surface 93*a* inclined downward in the direction of paper conveyance X. The guide member 94 adjoins the press roller 9*b* and downstream end 16*c* and has a flat top surface 94*a* inclined upward in the direction X. In this configuration, the guide members 93 and 94 and belt 16 form a paper conveyance path R between the spaced print positions E1 and E2. Because the paper conveyance path R includes the inclined flat surfaces 93*a* and 94*a*, the overall length of the path R, i.e., a paper conveyance distance W which the paper 22 moves from the print position E1 to the print position E2 is greater than the distance L by the sum of lengths P1 and P2.

Assume that the paper 22 extends over both the print positions E1 and E2, and that the peripheral speed V2 of the ink drum 1B is higher than the peripheral speed V1 of the ink drum 1A by one caused or another. Then, with the paper conveyance distance W greater than the distance L by the lengths P1 and P2, it is possible to obviate an occurrence that the paper 22 is pulled by the downstream ink drum 1B while printing is under way at the upstream print position E1. This insures expected printing at the print position E1 and prevents the image of the first color from being dislocated relative to an image of the second color to be formed at the print position E2.

Figure 5:
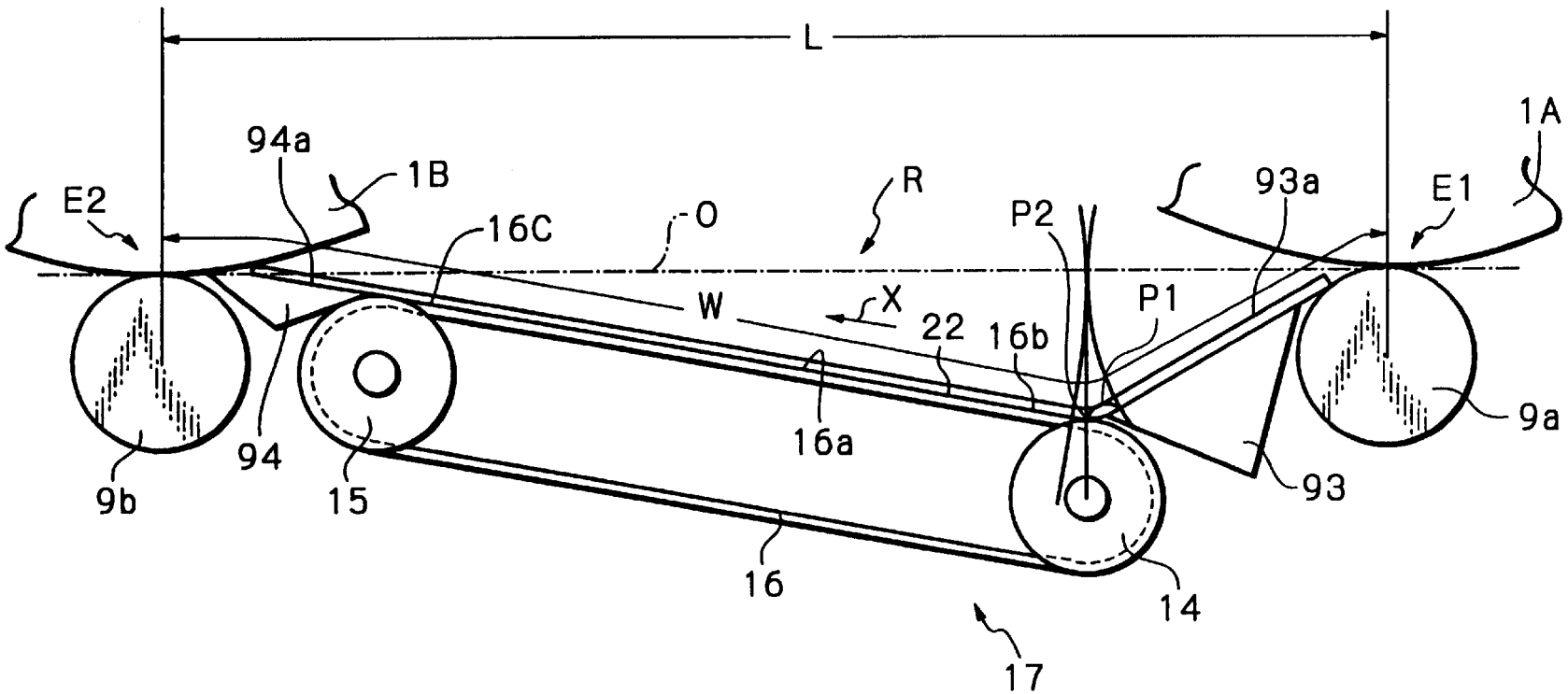
FIGS. 5 and 6 are fragmentary enlarged front views each showing a particular modification of the embodiment of FIG. 4.

FIG. 5 shows a modified form of the intermediate conveyor 17. As shown, the upstream end 16*b* and downstream end 16*c* of the belt 16 are positioned below the line 0, but the downstream end 16*c* is positioned above the upstream end 16*b*. The conveying surface 16*a* is therefore inclined upward in the direction of paper conveyance X. The guide members 93 and 94 are respectively positioned between the upstream print position E1 and the upstream end 16*b* and between the downstream end 16*c* and the downstream print position E2, as in the above embodiment.

In the modification shown in FIG. 5, the guide member 94 adjoining the press roller 9*b* and downstream end 16*c* has the top surface 94*a* made up of an inclined portion contiguous with the conveying surface 16*a* and a flat portion parallel to the line 0. The inclined portion and flat portion merge into each other. In the modification, therefore, the paper conveyance path R between the print positions E1 and E2 is formed by the downwardly inclined surface 93*a*, upwardly inclined conveying surface 16*a*, and the surface 94*a* made up of the inclined portion and flat portion. This is also successful to make the overall length of the path R, i.e., the paper conveyance distance W greater than the distance L by the sum of lengths P1 and P2. The modification therefore also obviates the undesirable occurrence described in relation to the above embodiment.

Figure 6:
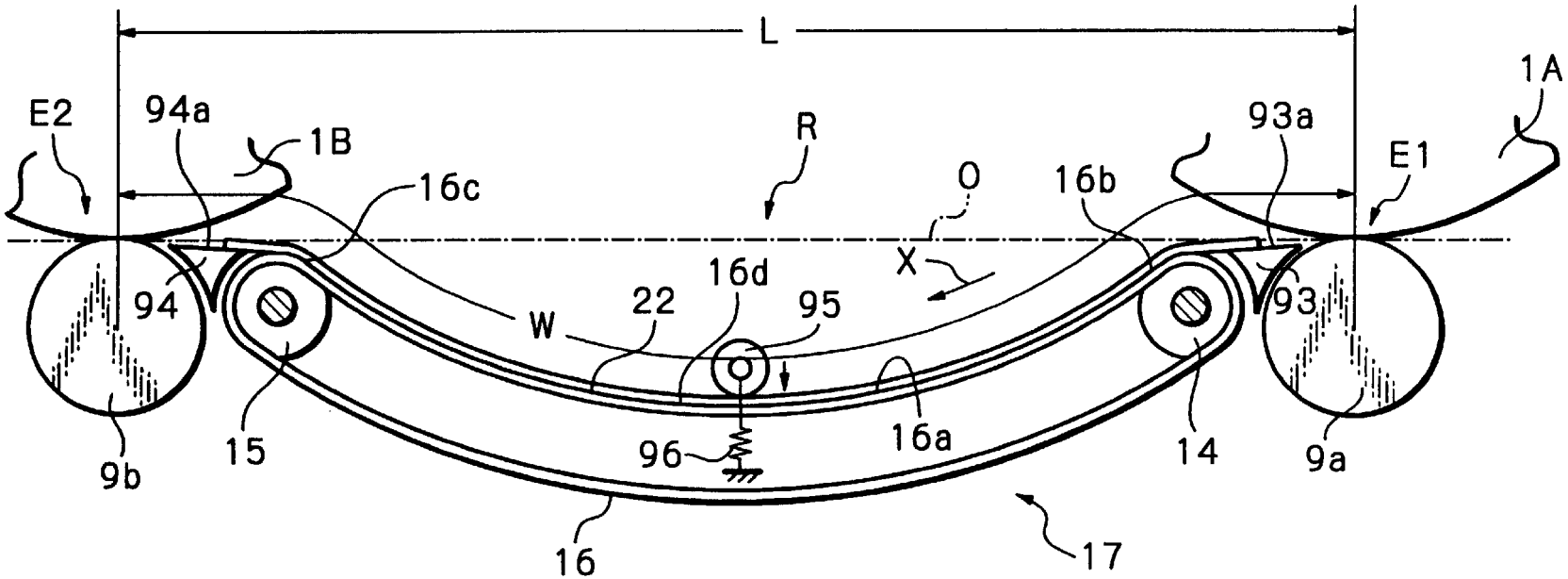

FIG. 6 shows another modification of the conveyor 17. As shown, the upstream end 16*b* and downstream end 16*c* of the belt 16 are positioned below the line 0 as in the illustrative embodiment. In this modification, the conveying surface 16*a* has its intermediate portion 16*d* curved downward in the direction perpendicular to the line 0. It is to be noted that the downward curvature is an example of curvature perpendicular to the line 0. A pair of rollers 95 (only one is visible) respectively contact opposite side edges of the intermediate portion 16*d* which do not contact the paper 22. Each roller 95 is constantly biased downward by a tension spring 96. In this condition, the rollers 95 press the intermediate portion 16*a* downward and thereby form the curved conveying surface 16*a*. Again, the guide members 93 and 94 are respectively positioned between the upstream print position E1 and the upstream end 16*b* and between the downstream end 16*c* and the downstream print position E2.

The top surfaces 93*a* and 94*a* of the guide members 93 and 94, respectively, are so configured as to smoothly merge into the upstream end 16*b* and downstream end 16*c*, respectively. In this configuration, too, the overall length of the paper conveyance path R, i.e., the paper conveyance di stance W is greater than the distance L between the print positions E1 and E2, also solving the problem discussed in relation to the illustrative embodiment.

Referring again to FIG. 1, a paper size sensor or paper size sensing means 56 is mounted on the paper tray 21 in the vicinity of the outermost end 21*a* of the tray 21. A paper passage sensor or paper size recognizing means 46 is located on the paper conveyance path R in the vicinity of the registration rollers 29 and 30 and is responsive to the length of the paper 22 in the direction of paper conveyance X. The two sensors 46 and 56 constitute paper sensing means in combination.

The paper size sensor 56 is responsive to a reference length of the papers 22 stacked on the paper tray 21 and is spaced from the innermost end 21*b* of the paper tray 21 by a preselected distance L1. The distance L1 is slightly longer than the paper conveyance distance W. The paper size sensor 56 is implemented by a conventional reflection type photosensor made up of a light emitting device and a light-sensitive device. When the papers 22 are present on the tray 21, a reflection from the papers 22 is incident to the sensor 56 and turns it on. The output of the sensor 56 therefore shows whether or not the papers 22 on the tray 21 has a preselected length (reference length) L1. The length L1 should preferably be W+α, as will be described specifically later.

The paper passage sensor 46 is responsive to an interval between the time when the leading edge of the paper 22 coming out of the registration rollers 29 and 30 reaches the sensor 46 and the time when the trailing edge of the same paper 22 moves away from the sensor 46. In the illustrative embodiment, the paper passage sensor 46 is used in combination with the paper size sensor 56. When the paper size sensor 56 determines that the length of the papers 22 on the paper tray 21 is greater than the paper conveyance distance W, the paper passage sensor 46 translates the length into a period of time. The resulting time data allows how long the papers 22 actually is to be determined. The paper passage sensor 46 is also implemented by a reflection type photosensor.

Figure 3:
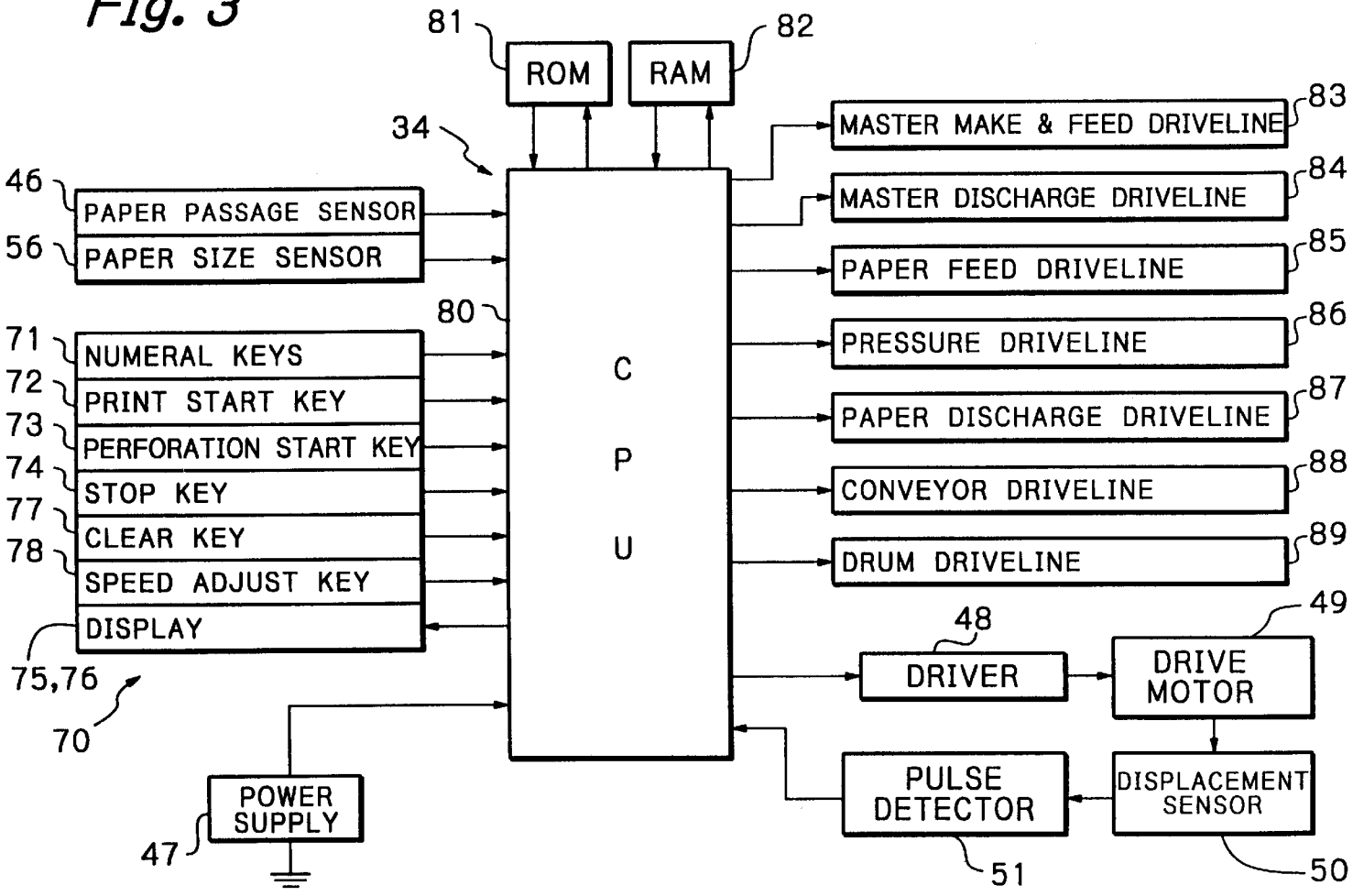
FIG. 3 is a block diagram schematically showing control means also included in the stencil printer.

The drum driveline 89, FIG. 3, is connected to the ink drums 1A and 1B via power transmitting means, not shown, and causes the drums 1A and 1B to rotate at identical peripheral speeds V1 and V2, respectively. The conveyor driveline 88, FIG. 3, drives the belt 16 at the peripheral speed V3 basically equal to the peripheral speeds V1 and V2 and drives the suction fan 18.

As shown in FIGS. 2 and 3, the numeral keys 71, print start key 72 and perforation start key 73 are arranged on the operation panel 70, and each is assigned to a particular function, as stated earlier. Further arranged on the operation panel 70 are a stop key 74 for interrupting the procedure ending with the printing step, a display 75 for displaying, e.g., the number of printings input on the numeral keys 71 and implemented by LEDs (Light Emitting Diodes), a monitor display 76 for showing the operator that the size of the papers 22 stacked on the tray 21 is inadequate, a clear key 77 for clearing, e.g., the number of printings input on the numeral keys 71, and speed control keys 78, i.e., an up key 78*b* and a down key 78*a* usable to vary the peripheral speeds of the ink drums 1A and 1B and belt 16 stepwise.

As shown in FIG. 3, the control means 34 is implemented by a conventional microcomputer including a CPU (Central Processing Unit) 80, an I/O (Input/Output) port, not shown, a ROM (Read Only Memory) 81 and a RAM (Random Access Memory 82) interconnected by a signal bus not shown. The control means 34 and the various keys 71–74, 77 and 78 displays 75 and 76 of the operation panel 70, paper passage sensor 46 and paper size sensor 56 are electrically connected to each other and interchange command signals, ON/OFF signals, and data signals. A power supply 47 is connected to the CPU 80.

A master make and feed driveline 83, a paper discharge driveline 84, a paper feed driveline 85 and a pressure driveline 86 are additionally electrically connected to the control means 34. The master make and feed driveline 83 drives the master making devices 41*a* and 41*b* and stencil feeding sections not shown. The paper feed driveline 85 drives the paper feeding means 20. The pressure driveline 86 drives the pressing devices 32*a* and 32*b*. The paper discharge driveline 87 drives the air pressure source not shown. The control means 34 interchanges command signals, ON/OFF signals and data signals with drivelines 83–89 for controlling the operations of the entire system including the starts and stops and timings of the various devices and drive mechanisms.

When the length of the papers 22 is greater than the reference length, as determined by the paper size sensor 56, the control means 34 inhibits the paper feeding means 20 from feeding the papers 22. Also, when the length of the paper 22 determined on the basis of the output of the paper passage sensor 46 is greater than the paper conveyance distance W, the control means 34 interrupts the printing operation after the paper 22 sensed by the sensor 46 has been driven out to the tray 37. For this purpose, the ROM 81 stores a table listing experimentally determined data representative of a relation between paper conveying times and the lengths of the papers 22. The paper conveying times each correspond to a particular size of the papers 22, a particular peripheral speed V1 of the ink drum 1A, and a particular peripheral speed V3 of the belt 16. The control means 34 reads such data out of the ROM 81 in accordance with the size of the papers 22 and peripheral speeds, as needed, and controls the various sections of the printer on the basis of the data. Further, the ROM 81 stores a program relating to the starts and stops of the various devices and drivelines as well as necessary fixed data.

Figure 7:
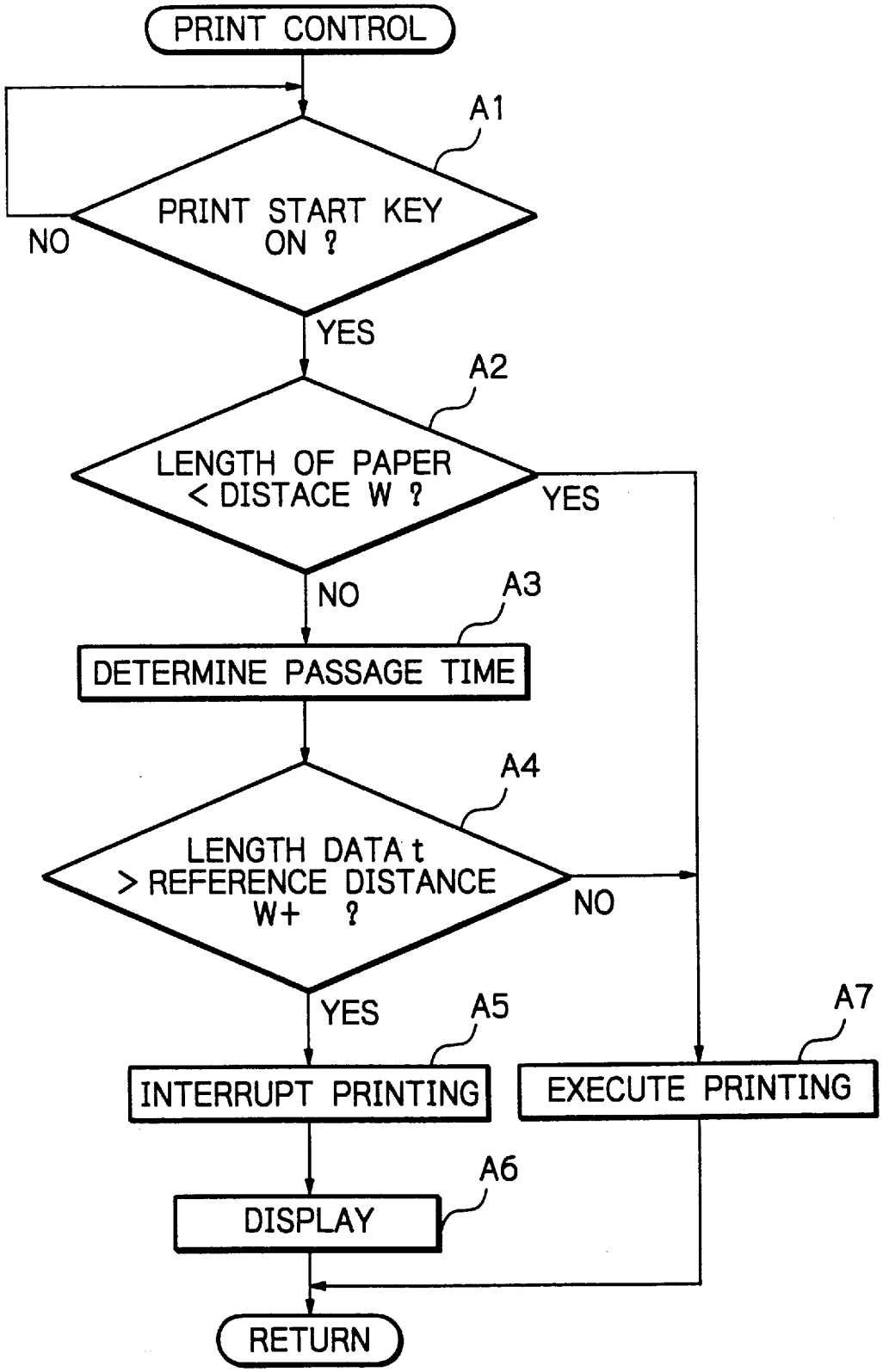
FIG. 7 is a flowchart demonstrating a specific operation of the embodiment of FIG. 4.

Reference will be made to FIG. 7 for describing a specific operation of the illustrative embodiment. As shown, the control means 34 determines whether or not the operator has pressed the print start key 72 (step A1). If the answer of the step A1 is positive (Yes), then the control means 34 compares the length of the papers 22 in the direction of paper conveyance X determined by the paper size sensor 56 and the paper conveyance distance W (step A2). If the length of the papers 22 is smaller than the distance W, i.e., if the paper size sensor 56 does not turn on (Yes, step A2), then the control means 34 executes the previously stated printing operation with the papers 22 (step A7).

Assume that the paper size sensor 56 has turned on, showing that the length of the papers 22 in the direction X is greater than the distance W (No, step A2). Then, the control means 34 determines how long the paper 22 actually is on the basis of the output of the paper passage sensor 46 when the paper 22 is fed (step A3). Subsequently, the control means 34 compares length data t output from the paper passage sensor 46 and the reference paper conveyance distance W+α (step A4). If the length data t is greater than the distance W+α (Yes, step A4), the control means 34 interrupts the printing operation after a trial printing has been driven out (step A5) and informs the operator of the inadequate paper size via the monitor display 76 (step A6). If the answer of the step A4 is No, the controller 34 executes the printing operation (step A7).

As for the reference transport distance W+α, α is the distance over which the ink drum 1A conveys the paper 22 within the period of time in which the ink drum 1B fully conveys the paper 22 by the sum of the distances P1 and P2. The sum of the distances P1 and P2 is the difference, or margin, between the distances W and L.

As stated above, when the length of the papers 22 is greater than the reference paper conveyance distance W+α, the control means 34 interrupts the printing operation and informs the operator of the inadequate paper length. This prevents defective printing from continuing and clearly informs the operator of the reason why the printer has stopped operating. If desired, a drum speed sensor and a belt speed sensor may be arranged to sense the peripheral speed V1 of the ink drum 1A and the peripheral speed V3 of the belt 16, respectively. By counting the outputs of such additional sensors over the paper transporting time, it is possible to more surely determine a period of time needed for the passage of the paper 22. Consequently, accurate recognition of the paper 22 being conveyed is promoted to further reduce defecting printing. While the illustrative embodiment compares the length data t with the reference paper conveyance distance W+α, the length data t may, of course, be compared with the paper conveyance distance W.

While the above embodiment includes the paper passage sensor 46 and paper size sensor 56, the embodiment is operable only with the paper size sensor 56 if modified, as follows. In the modification, the paper size sensor 56 is spaced from the innermost edge 21*b* of the paper tray 21 by a distance at least equal to the paper conveyance distance W. When the sensor 56 senses the papers 22 on the paper tray 21 and turns on, the control means 34 determines that the papers 22 are longer than a preselected length (reference length). The control means 34 then displays the inadequate paper length and inhibits the pick-up roller 23 from rotating. This modification therefore fully obviates defective printings including a trial printing and therefore the wasteful consumption of the papers 22. The control means 34 may inhibit the registration rollers 29 and 30 from operating in place of the pick-up roller 23, if desired.

An alternative embodiment of the stencil printer in accordance with the present invention will be described with reference to FIG. 8. In this embodiment, structural elements identical with the structural elements of the previous embodiment are designated by like reference numerals and will not be described specifically in order to avoid redundancy. As shown, the printer includes moving means 53 for moving the intermediate conveyor 17 and a guide member 52 in accordance with the size (length) of the papers 22 such that the paper conveyance distance W increases. In the conveyor 17, the driven roller 14 is mounted on a shaft 14*a*. The shaft 14*a* is movably received in an arcuate guide slot 54 formed in a frame 69 shown in FIG. 9. The drive roller 14 is therefore angularly movable about a shaft 15*a* supporting the drive roller 15.

Figure 8:
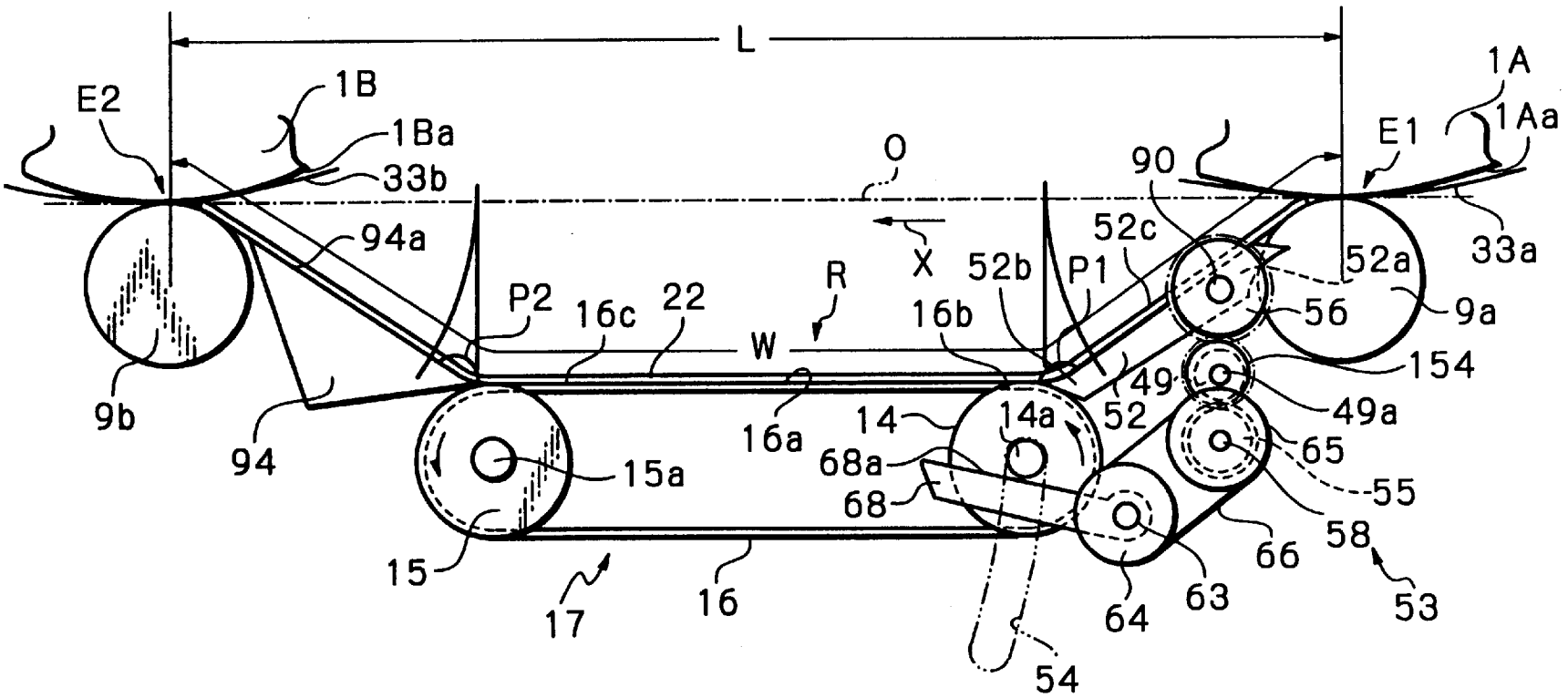
FIG. 8 is a fragmentary enlarged front view showing an alternative embodiment of the present invention including moving means.
Figure 9:
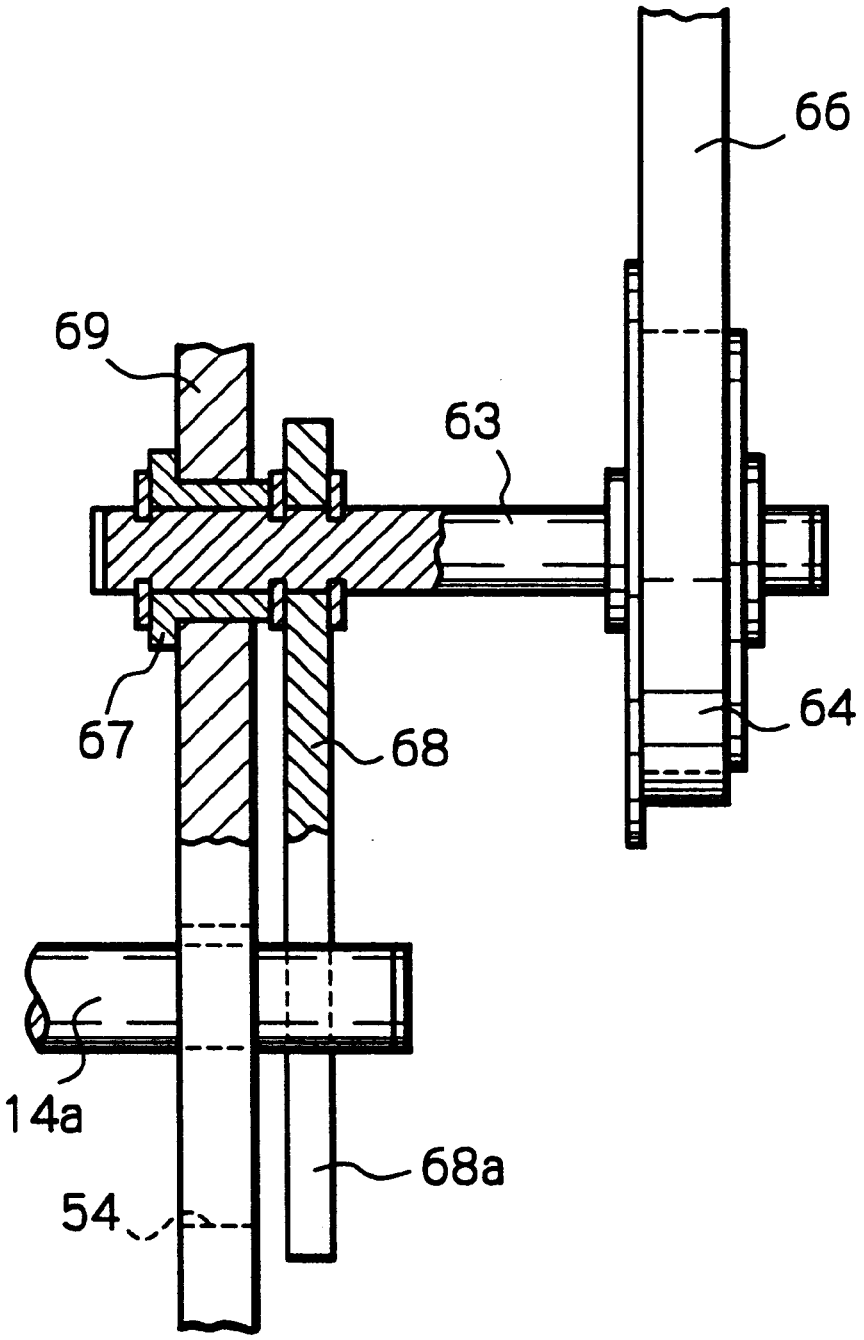
FIG. 9 is a fragmentary enlarged plan view showing the moving means.
Figure 10:
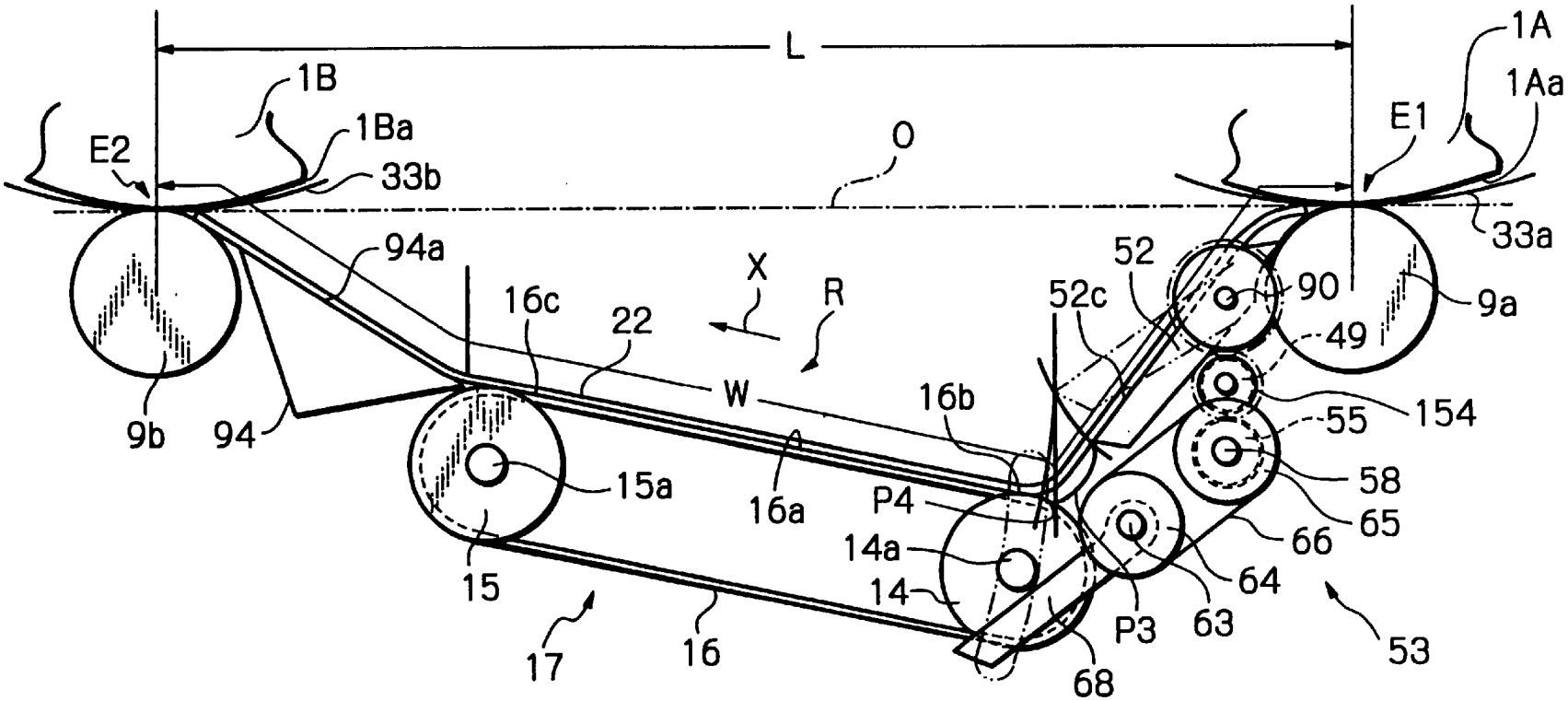
FIG. 10 is a fragmentary front view showing how the moving means extends a paper conveyance distance.

The moving means 53 selectively moves the conveyor 17 and guide member 52 to a first position shown in FIG. 8 or a second position shown in FIG. 10. The conveyor 17 and guide member 52 define the reference paper conveyance distance W in the first position or extend the distance W in the second position. The moving means 53 includes a drive motor or drive source 49 having an output shaft 49*a*. A drive gear 154 is mounted on the output shaft 49*a* and held in mesh with gears 55 and 56. The gear 55 is mounted on a shaft 58 journalled to the frame 69. A pulley 65 is also mounted on the shaft 58. A belt 66 is passed over the pulley 65 and a pulley 64 mounted on a shaft 63 rotatably supported by the frame 69 via a bearing 67. A lever 68 is affixed to the shaft 63 at its one end and supports the shaft 14*a* at its top 68*a*. The lever 68 is usually positioned such that the conveying surface 16*a* of the belt 16 remains substantially parallel to the line 0.

Figure 11:
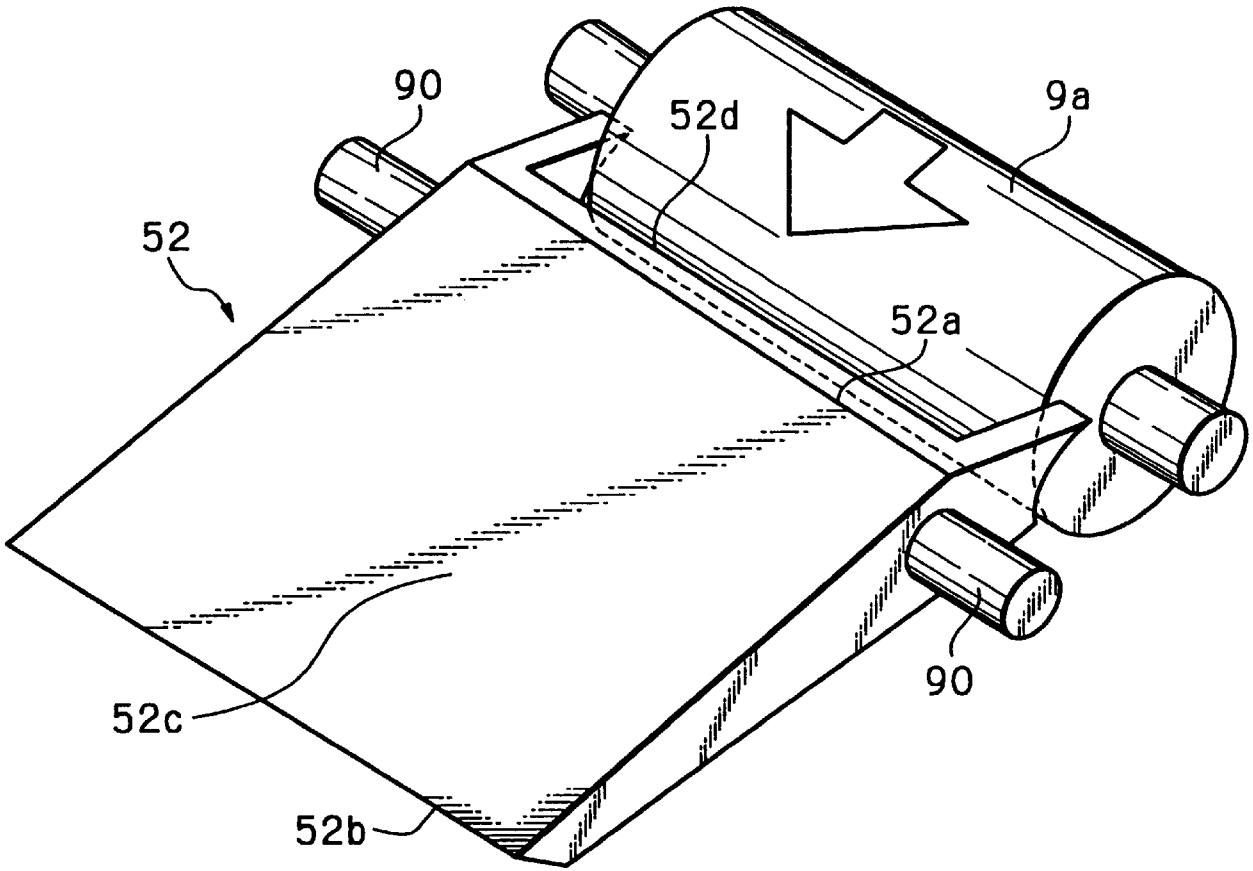
FIG. 11 is an enlarged perspective view of a guide member and a press roller included in the alternative embodiment.

The guide member 52 intervenes between the press roller 9*a* and the upstream end 16*b* of the belt 16. One end 52*b* of the guide member 52 adjoins the conveying surface 16*a* at the upstream end 16*b* side. The gear 56 is mounted on a shaft 90 mounted on the other end 52*a* of the guide member 52. The shaft 90 is journalled to the frame 69 so as to allow the guide member 52 to angularly move. The guide member 52 has a top surface 52*c* made up of an inclined surface and a flat surface and guides the paper 22 moved away from the upstream print position E1 to the belt 16. As shown in FIG. 11, the end 52*a* of the guide member 52 is formed with a recess 52*d*. The press roller 9*a* is partly received in the recess 65*d*, so that the paper 22 moved away form the print position E1 can be smoothly handed over to the guide member 52.

The top surface 52*c* of the guide member 52, conveying surface 16*a* of the belt 16 and the top surface 94*a* of the other guide member 94 form the paper conveyance path R. The overall length of the path R, i.e., the paper conveyance di stance W which the paper 22 moves from the upstream print position E1 to the downstream print position E2 is selected to be greater than the distance L between the positions E1 and E2 by the sum of the distances P1 and P2. It is to be noted that the above distance W is a reference distance set up in the first position shown in FIG. 8, i.e., when the conveyor 17 and guide member 52 are not moved.

The drive motor 49 is implemented by a stepping motor and connected to the CPU 80 via a driver 48, as shown in FIG. 3. A displacement sensor 50 is mounted on the output shaft 49*a* of the drive motor 49 for sensing the displacement of the guide member 52 and lever 68. The displacement sensor 50 is a conventional rotary encoder responsive to the rotation angle of the output shaft 49*a*. The output of the displacement sensor 50 is sent to the CPU 80 via a pulse detector 51.

The ROM 81 stores a table listing experimentally determined data representative of a relation between the lengths of the papers 22, the paper conveyance distances W, and the amounts of rotation of the drive motor 49. The control means 34 reads such data in accordance with the outputs of the paper size sensor 56 and paper passage sensor 46 in order to control the direction and amount of rotation of the drive motor 49.

Figure 12:
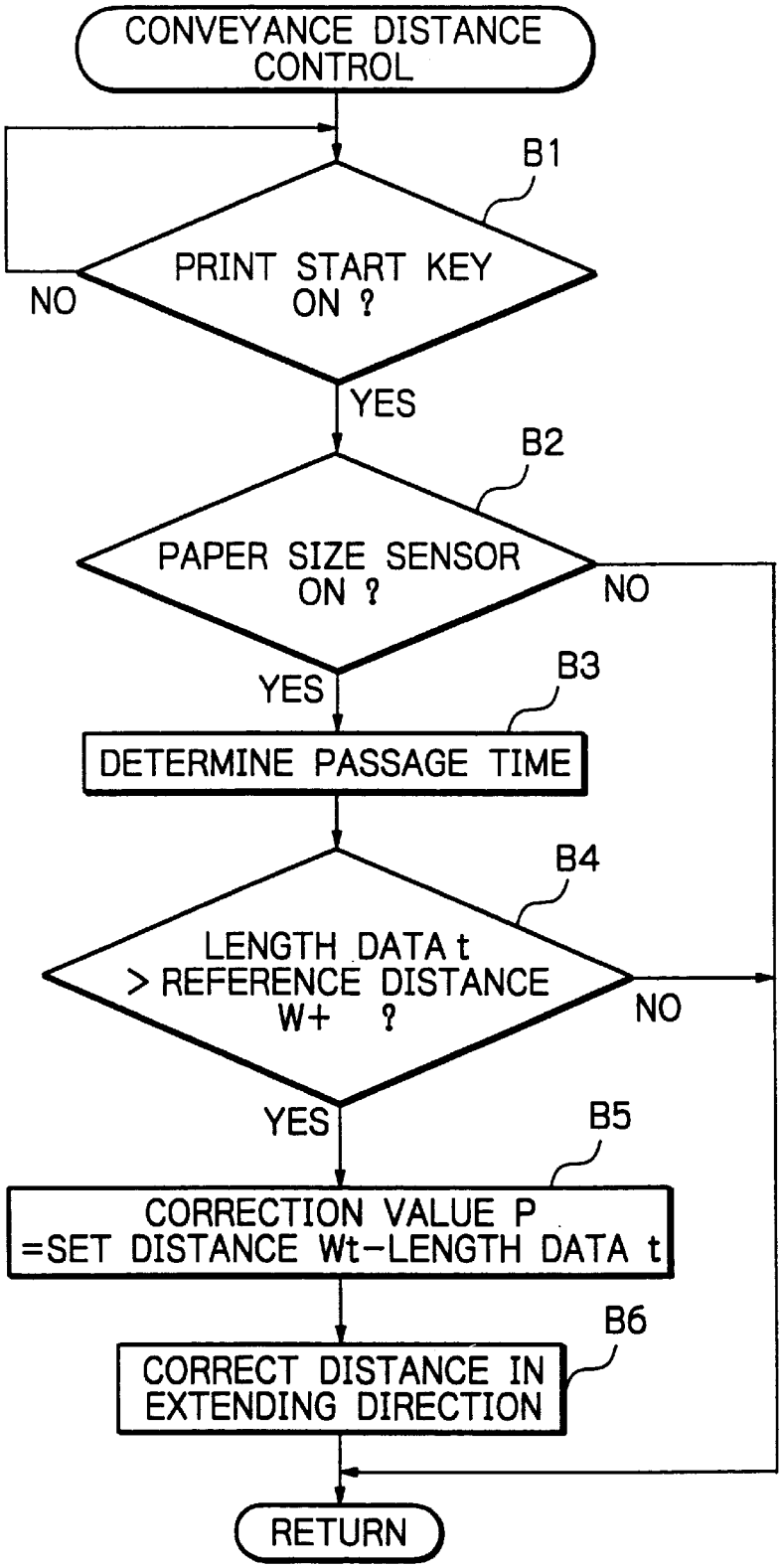
FIG. 12 is a flowchart demonstrating a specific operation of the alternative embodiment.

FIG. 12 demonstrates a specific operation of the illustrative embodiment. As shown, the control means 34 determines whether or not the print start key 72 is pressed (step B1). If the answer of the step B1 is Yes, the control means 34 determines the length of the papers 22 stacked on the paper tray 21 on the basis of the output of the paper size sensor 56 (step B2). When the paper size sensor 56 turns on (Yes, step B2), the control means 34 determines that the length of the papers 22 is greater than the paper conveyance distance W, and advances to a step B3. If the answer of the step B2 is No, meaning that the length of the papers 22 is smaller than the above distance W, then the control means 34 returns to the usual print control without controlling the paper conveyance distance.

In the step B3, the control means 34 determines the length of the paper 22 being conveyed on the basis of the output of the paper passage sensor 46. The control means 34 compares length data t output from the sensor 46 and the paper conveyance distance W+α (step B4). If the length data t is grater than the distance W+α (Yes, step B4), the control means 34 executes a step B5; if otherwise (No, step B4), the control means 34 returns to the usual print control without controlling the paper conveyance distance. By so determining the actual length of the paper 22, it is possible to see if the paper 22 will be pulled in the direction of conveyance when extending over both the print positions E1 and E2 or not.

In the step B5, the control means 34 calculates, based on the length data t and a set paper conveyance distance Wt, a correction value P for the paper 22. Subsequently, the control means 34 corrects the distance W in the extending direction with the correction value P (step B6) and then returns to the print control.

Specifically, the control means 34 calculated the correction value P causes the drive motor 49 to rotate by a preselected amount for extending the paper conveyance distance W. As shown in FIG. 8, the rotation of the drive motor 49 is transferred to the gears 55 and 56 via the drive gear 154. The gear 55, in turn, causes the pulley 64 to rotate via the pulley 65 and belt 66, thereby lowering the lever 68 via the shaft 63. As a result, the shaft 14*a* resting on the top surface 68*a* of the lever 68 is moved along the arcuate guide slot 54. The conveyor 17 is therefore lowered about the shaft 15*a* to the second position.

On the other hand, the gear 56 causes the shaft 90 to rotate and thereby lowers the guide member 52. Consequently, in the second position shown in FIG. 10, the paper conveyance path W is extended by displacements P3 and P4 respectively implemented by the movement of the guide member 52 and that of the conveyor 17.

As stated above, the paper conveyance path W increases with an increase in the length of the paper 22. Therefore, even when the length or the conveyance speed of the paper 22 varies, the paper 22 is prevented from being pulled by the ink drum 1B while an image is printed thereon at the upstream print position E1. This insures desirable printing at the upstream print position E1 and prevents an image from being dislocated at the downstream print position E2.

Figure 13:
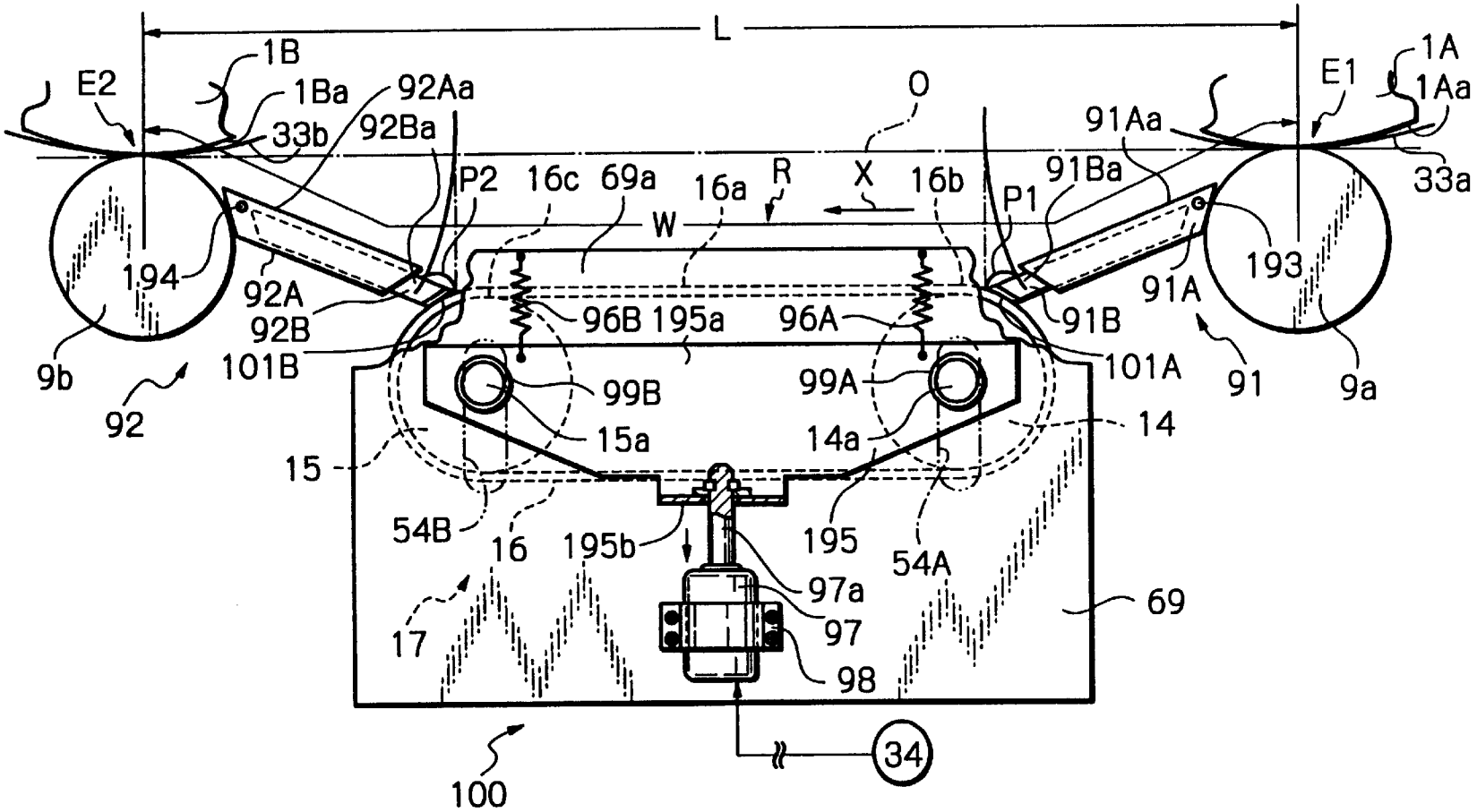
FIG. 13 is an enlarged front view showing a modification of the moving means.

FIG. 13 shows a modification of the above embodiment. As shown, the modification includes moving means 100 for moving the intermediate conveyor 17 up and down and renders the guide members 91 and 92 angularly movable and slidable. The modification is also successful to vary the paper conveyance distance W in accordance with the length of the paper 22.

Specifically, the guide members 91 and 92 are respectively positioned between the upstream print position E1 and the upstream end 16*b* and between the downstream end 16*c* and the downstream print position E2. The guide members 91 and 92 are angularly movable about shafts 193 and 194, respectively. The guide member 91 is made up of a body 91A and a member 91B slidably mounted on the body 91A and having a section in the form of a letter U. Likewise, the guide member 92 is made up of a body 92A and a member 92B slidably mounted on the body 91B and having a generally U-shaped section. The guide members 91 and 92 have ends 101A and 101B adjoining the upstream end 16*a* and downstream end 16*c*, respectively. The body 91A and slidable member 91B respectively have flat tops 91A*a* and 91B*a* inclined downward from the upstream print position E1 toward the upstream end 16*b*. The body 92A and 92B respectively have flat tops 92A*a* and 92B*a* inclined upward from the downstream end 16*c* toward the downstream print position E2.

Figure 14:
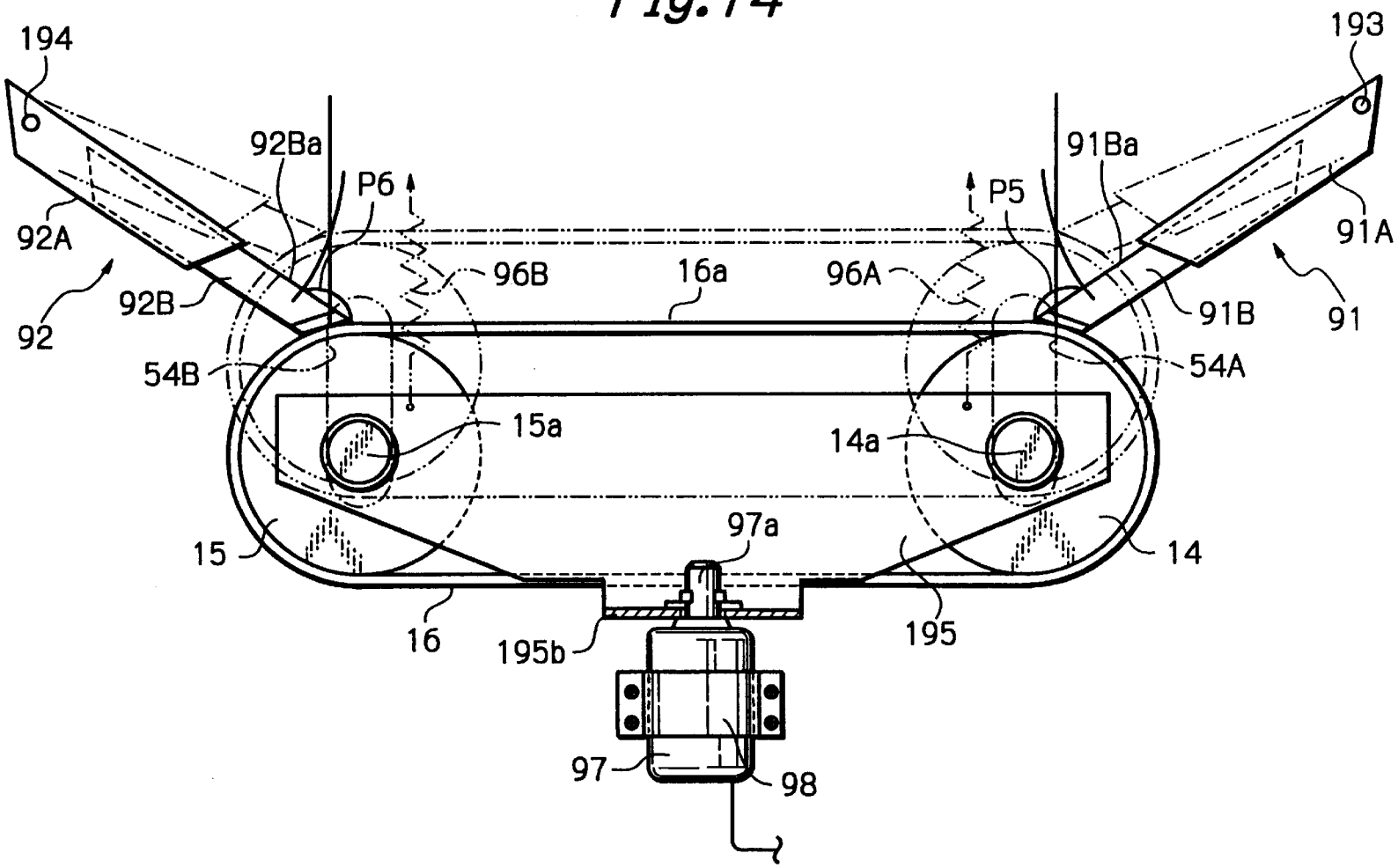
FIG. 14 is an enlarged front view showing how the moving means of FIG. 13 extends the paper conveyance distance.

The moving means 100 selectively moves the conveyor 17 to a first position shown in FIG. 13 or a second position shown in FIG. 14. The conveyor 17 implements the reference paper conveyance distance W in the first position or extends the distance W in the second position. The moving means 100 includes a movable frame 195 connected at its bottom 195*b* to a plunger 97*a* extending out from an electromagnetic solenoid or drive source 97. The shafts 14*a* and 15*a* of the driven roller 14 and drive roller 15, respectively, are horizontally journal led to the movable frame 195 via bearings 99A and 99B, respectively. Guide slots 54A and 54B are formed in a frame 69, and each extends over a preselected range in the up-and-down direction. The shafts 14*a* and 15*a* are respectively passed through the guide slots 54A and 54B and supported by the movable frame 195. The solenoid 97 is affixed to the frame 69 by a mounting member 98 with the plunger 97 extending upward. A drive signal input to the solenoid 97 causes the solenoid 97 to pull the plunger 97*a* thereinto.

Tension springs 96A and 96B are respectively anchored to the right portion and left portion of the upper part 195*a* of the movable frame 195 at one end. The other ends of the tension springs 96A and 96B are anchored to the upper part 69*a* of the frame 69. The springs 96A and 96B therefore constantly bias the conveyor 17 toward the first position shown in FIG. 13.

In the above configuration, the top surfaces 91A*a* and 91B*a*, top surfaces 92A*a* and 92B*a* and conveying surface 16*a* form the paper conveyance path R. The overall length of the path R, e.g., the paper conveyance distance W which the paper 22 moves from the upstream print position E1 to the downstream print position E2 is greater than the distance L by the sum of P1 and P2. It is to be noted that the above distance W is a reference distance set up in the first position shown in FIG. 13; the distance W in the first position is the reference paper transport distance.

In this modification, the solenoid 97 is connected to the CPU 80, FIG. 3, in place of the drive motor 49 via the driver 48. The displacement sensor 50 and pulse detector 51 are therefore omitted. The modification is constructed such that when the paper size sensor 56 turns on, the length of the papers 22 is determined to be greater than the paper conveyance distance W, and a drive signal is input to the solenoid 97. Therefore, when the paper size sensor 56 turns on, the solenoid 97 pulls the plunger 97*a* downward with the result that the conveyor 17 is lowered from a position indicated by a dash and-dots line in FIG. 14 to a position indicated by a solid line in FIG. 14.

Figure 15:
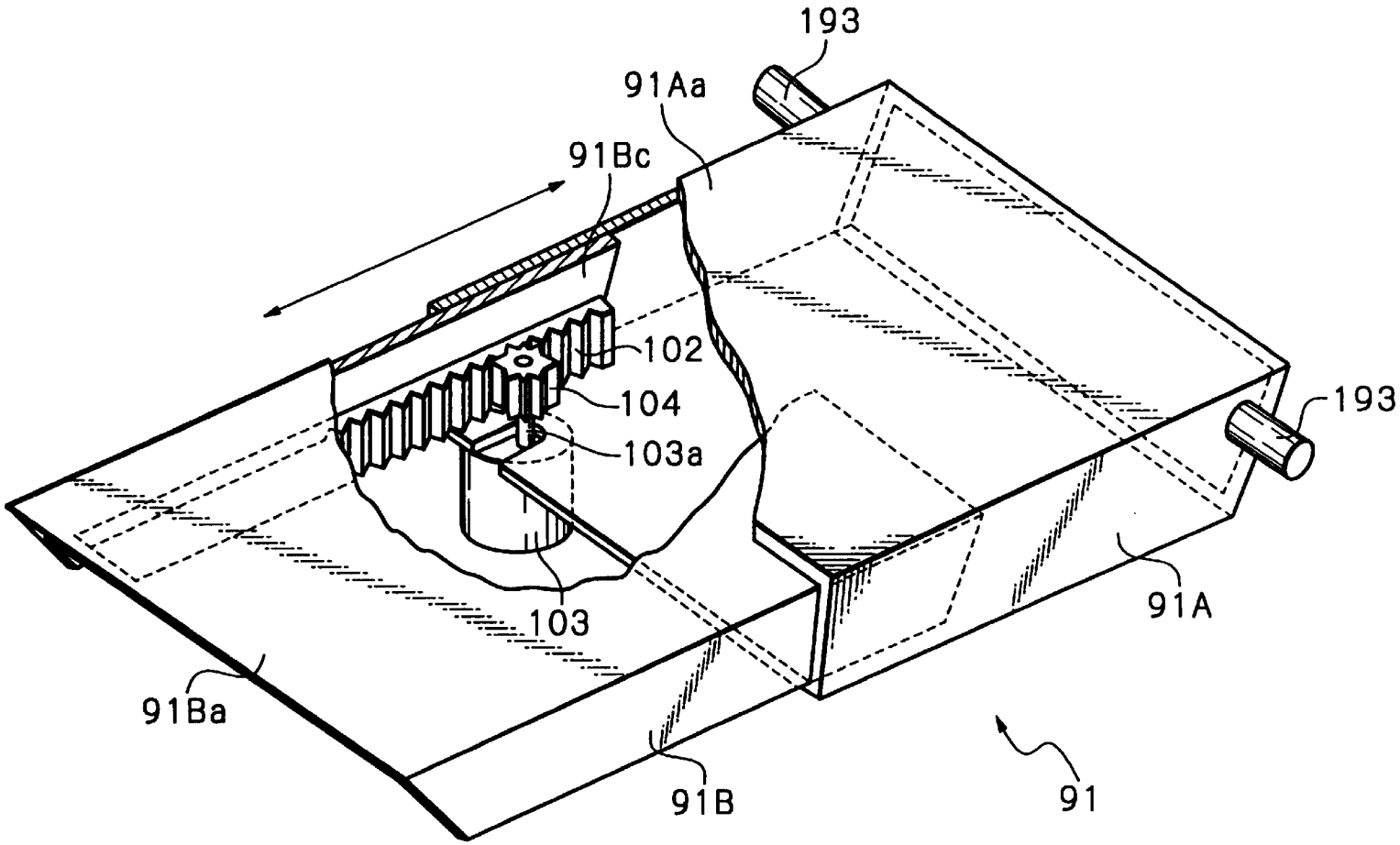
FIG. 15 is a fragmentary perspective view showing the guide member.

As shown in FIG. 15, the guide member 91 includes a rack 102 mounted on the inner side surface 91B*c* of the slidable member 91B. A drive motor 103 has an output shaft 103*a* on which a pinion gear 104 is mounted. The pinion gear 104 is held in mesh with the rack 102 for causing it to move. The member 91 B is therefore slidable relative to the body 91A independently of the conveyor 17. This is also true with the other guide member 92. The guide members 91 and 92 each are caused to move about the shaft 193 or 194 by the same mechanism as described in relation to the guide member 52.

In the second position shown in FIG. 14, the paper conveyance distance W is increased by the displacement or slide P5 of the member 91B and the displacement or slide P6 of the member 92B, compared to the first position shown in FIG. 13. This is also successful to achieve the advantages discussed earlier.

Figure 16:
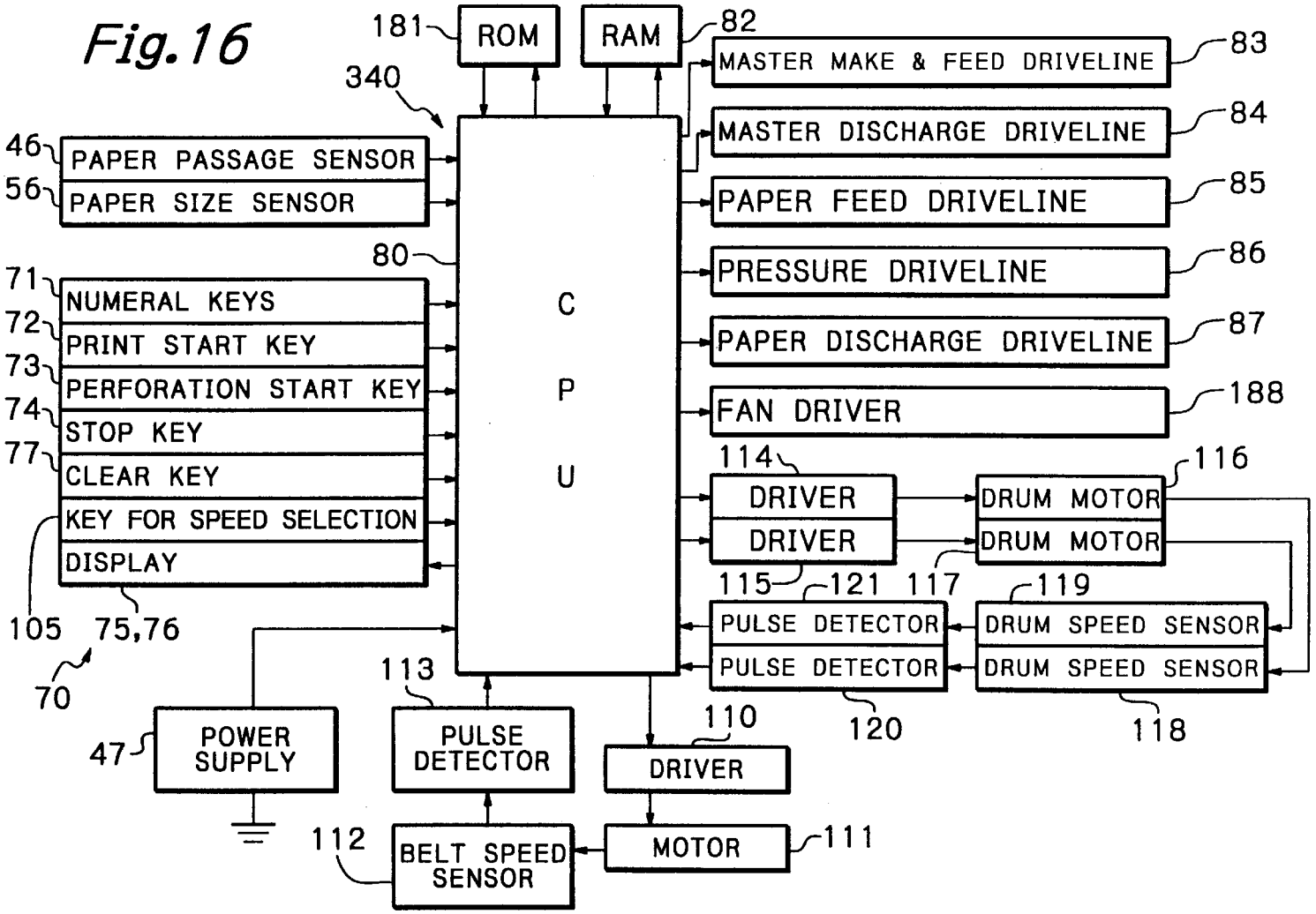
FIG. 16 is a block diagram schematically showing control means representative of another alternative embodiment of the present invention.

FIG. 16 shows control means 340 representative of another alternative embodiment of the present invention. Briefly, when the length of the papers 22 in the direction of paper conveyance X determined by the paper passage sensor 46 is greater than the paper conveyance distance W, the control means 340 maintains the peripheral speed or conveying speed V3 of the belt 16 higher than the peripheral speed or conveying speed V1 of the ink drum 1A while the paper 22 is conveyed from the print position E1 to the print position E2. Let this mode be referred to as an acceleration mode. A key 105 for allowing the operator to select the acceleration mode is provided on the operation panel 70 and serves as conveyance control selecting means. Because the control means 340 is basically identical with the control means 34 shown in FIG. 3, identical structural elements are designated by identical reference numerals.

As shown in FIG. 16, drum motors 116 and 117 drive the ink drums 1A and 1B, respectively, and are connected to the CPU 80 via drivers 114 and 115, respectively. Drum speed sensors 118 and 119 are respectively responsive to the peripheral speeds V1 and V2 of the ink drums 1A and 1B and implemented by rotary encoders mounted on the output shafts of the drum motors 116 and 117, respectively. The outputs of the sensors 118 and 119 are sent to the CPU 80 via pulse detectors 120 and 121, respectively.

A belt speed sensor 112 is responsive to the peripheral speed V3 of the belt 16 and implemented by a rotary encoder. The rotary encoder is mounted on the output shaft of a belt motor 111 connected to the CPU 80 via a driver 110. The output of the belt speed sensor 112 is sent to the CPU 80 via a pulse detector 113. The key 105 mentioned earlier is ALSO connected to the CPU 80.

The control means 340 includes a ROM 181 storing program relating to the starts and stops and timings of the various devices and drive sections. Further, the ROM 181 stores a table listing experimentally determined data representative of a relation between paper conveying times determined by the sizes of the papers 22, the peripheral speeds V1 and V2 of the ink drums 1A and 1B and the peripheral speed of the belt 16 and the lengths of the papers 22. In addition, the ROM 181 stores an equivelocity mode and the acceleration mode. In the equivelocity mode, the control means 340 controls the various drive sections such that the peripheral speeds V1 and V2 of the ink drums 1A and 1B and the peripheral speed V3 of the belt 16 are equal to each other. In the acceleration mode, the control means 340 maintains the peripheral speed V3 higher than the peripheral speed V1 for a period of time necessary for the leading edge of the paper 22 to move from the print position E1 to the print position E2. The fan 18 of the conveyor 17 is driven by a fan driver 188.

Figure 17:
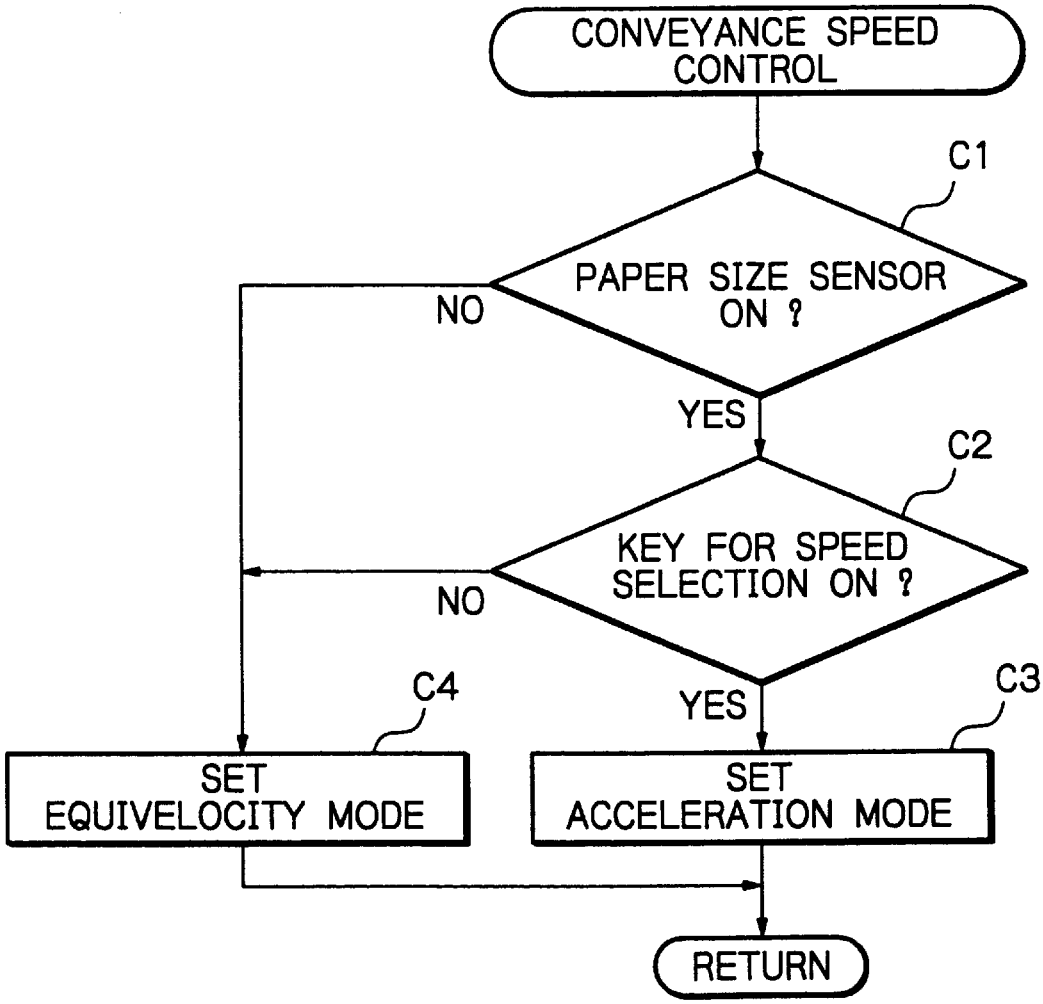
FIG. 17 is a flowchart representative of a specific operation of the embodiment shown in FIG. 16.

A specific operation of the illustrative embodiment will be described with reference to FIG. 17. As shown, the control means 340 determines the length of the papers 22 stacked on the paper tray 21 on the basis of whether or not the paper size sensor 56 has turned on (step C1). If the answer of the step C1 is No, then the control means 340 determines that the length of the papers 22 is smaller than the paper conveyance distance W, sets up the equivelocity mode (step C4), and then returns.

If the answer of the step C1 is Yes, meaning that the paper size sensor 56 has turned on, then the control means 340 determines whether or not the key 105 has been pressed (step C2). If the answer of the step C2 is Yes, the control means 340 sets up the acceleration mode (step C3); if otherwise (No, step C2), the control means 340 sets up the equivelocity mode.

Assume that the operator, looking at an image (deviation) printed on a trial printing, determines that the peripheral speed V1 of the ink drum 1A is higher than the peripheral speed V2 of the ink drum 1B. Then, the operator presses the key 105. In response, the control means 340 maintains the peripheral speed V3 of the belt 16 higher than the peripheral speed V1 of the ink drum 1A for a period of time necessary for the leading edge of the paper 22 to move from the print position E1 to the print position E2. As a result, the paper 22 is preventing from bending on the belt 16 due to the peripheral speed V2 lower than the peripheral speed V1. Should the paper 22 bend on the belt 16, it would contact the ink drum 1B and would be smeared thereby or would crease at the print position E2. Consequently, an image can be printed on the paper 22 at the print position E2 in accurate register with the image printed at the print position E1.

While the above embodiment uses the paper size sensor 56 for determining the length of the papers 22, it may, of course, use the paper passage sensor 46 for the same purpose. In the illustrative embodiment, the operator determines a difference between the peripheral speeds V1 and V2 by looking at a trial printing. Alternatively, the outputs of the drum speed sensors 118 and 119 may be compared in order to automatically determine a difference between the peripheral speeds V1 and V2.

In summary, it will be seen that the present invention provides a stencil printer having various unprecedented advantages, as enumerated below.

(1) A paper conveyance distance over which a paper is conveyed from an upstream print position to a downstream print position is longer than a distance between the two print positions. Therefore, even when the paper being conveyed extends over both the two print positions, it is prevented from being pulled in a direction of conveyance. It follows that defective printing is reduced even when the peripheral speeds of a plurality of ink drums are different from each other.

(2) An intermediate conveyor has a conveying surface for conveying the paper while retaining it thereon. At least one of the upstream and downstream end of the conveying surface adjoining the upstream print position and downstream print position, respectively, is positioned below an imaginary line connecting the two print positions. This also makes the paper conveyance distance longer than the distance between the two print positions and therefore successfully achieves the above advantage (1).

(3) A guide member is positioned between the upstream print position and the upstream end of the conveying surface and/or between the downstream end of the conveying surface and the downstream print position. The guide member guides the paper toward the conveying surface or the downstream print position. This is also successful to achieve the advantage (1). In addition, the leading edge of the paper is surely conveyed to the conveying surface or the downstream print position.

(4) When the size of papers stacked on paper feeding means has a reference length, the papers are not fed. This is also successful to achieve the advantages (1) and (3). In addition, no papers of inadequate size are fed, so that not a single paper is wasted.

(5) When the length of the paper recognized by paper size recognizing means positioned on a paper conveyance path is greater than the paper conveyance distance, the feed of a new paper and printing operation are interrupted. This also successful to achieve the advantages (1) and (3). In addition, only the papers recognized are fed and subjected to printing, so that no papers other than a trial printing are wasted.

(6) Moving means moves the intermediate conveyor and/or the guide member in accordance with the length of the paper in the direction of conveyance in a direction in which the paper conveyance distance increases. This is also successful to achieve the advantages (1) and (3). In addition, the paper conveyance distance is variable in accordance with length of the paper, so that the paper is prevented from being pulled or slackened in the direction of conveyance due to a difference in length.

(7) When the length of the paper in the direction of conveyance is greater than a reference paper conveyance distance, the intermediate conveyor and/or the guide member is brought to a second position for extending the paper conveyance distance. This is also successful to achieve the advantages (1), (3) and (6).

(8) When the ink drum located at the upstream side rotates at a higher peripheral speed than the ink drum located at the downstream side, an acceleration mode is selected on conveyance control selecting means. As a result, the paper conveying speed of the intermediate conveyor is made higher than the conveying speed of the upstream ink drum. This is also successful to achieve the advantage (1). In addition, the slackening of the paper on the intermediate conveyor is reduced more positively.

Various modifications will become possible for those skilled in the art after receiving the teachings of the present disclosure without departing from the scope thereof.

What is claimed is:

1. A stencil printer comprising:

a plurality of ink drums spaced from each other in a direction of paper conveyance, and each having a respective master wrapped therearound and fed with ink from ink feeding means to an inner periphery thereof;

a plurality of pressing devices each being configured to move toward and away from one of said plurality of ink drums; and an intermediate conveyor for conveying a paper on which an image is printed at an upstream print position where an upstream one of said plurality of ink drums in the direction of paper conveyance and one of said plurality of pressing devices associated with said upstream one nip said paper to a downstream print position where a downstream of said plurality of ink drums in said direction and the other of said plurality of pressing devices associated with said downstream one nip said paper, said intermediate conveyor being positioned between said upstream ink drum and said downstream ink drum, wherein a paper conveyance distance which the paper moves while being conveyed from said upstream print position to said downstream print position is made sufficiently longer than a distance between said upstream print position and said downstream print position such that the paper is not pulled by said downstream ink drum while being printed at said upstream ink drum.

2. A stencil printer as claimed in claim 1, wherein said intermediate conveyor has a conveying surface for conveying the paper while retaining said paper thereon and having an upstream end and a downstream end respectively adjoining said upstream print position and said downstream print position, at least one of said upstream end and said downstream end being positioned below an imaginary line connecting said upstream print position and said downstream print position.

3. A stencil printer as claimed in claim 2, further comprising a guide member positioned in at least one of a space between said upstream print position and said upstream end and a space between said downstream end and said downstream print position for guiding the paper being conveyed in the direction of paper conveyance to said conveying surface or said downstream print position.

4. A stencil printer as claimed in claim 3, further comprising:

a paper feeding device configured to feed the paper toward said upstream print position;

a paper size sensing device included in said paper feeding device and configured to sense a length of the paper relative to a reference length in the direction of paper conveyance; and a control device configured to interrupt paper feed from said paper feeding device in response to an output of said paper size sensing device representative of the length of the paper greater than the reference length.

5. A stencil printer as claimed in claim 3, further comprising:

a paper size recognizing device positioned on a paper transport path and configured to recognize a length of the paper being conveyed in the direction of paper conveyance; and a control device configured to interrupt, when the length of the paper recognized by said paper size recognizing device is greater than the paper conveyance distance, at least one of paper feed from said paper feeding device and printing after the paper recognized by said paper size recognizing device has been driven out of said stencil printer.

6. A stencil printer as claimed in claim 3, further comprising:

a paper sensing device configured to sense the length of the paper in the direction of paper conveyance;

a moving device configured to move at least one of said intermediate conveyor and said guide member in a direction in which the paper conveyance distance increases; and a control device configured to operate said moving device in accordance with an output of said paper sensing device.

7. A stencil printer as claimed in claim 6, wherein said moving device is selectively movable to a first position where at least one of said intermediate conveyor and said guide member defines a reference paper conveyance distance and a second position where said reference paper conveyance distance increases, said control device causing, when the output of said paper sensing device shows that the length of the paper is greater than said reference paper conveyance distance, said moving device to move at least one of said intermediate conveyor and said guide member to said second position.

8. A stencil printer as claimed in claim 3, further comprising:

a paper sensing device configured to sense the length of the paper in the direction of paper conveyance; and a conveyance control selecting device configured to select, when the length of the paper sensed by said paper sensing device is greater than the paper conveyance distance, an acceleration mode in which a conveying speed of said intermediate conveyor is maintained higher than a conveying speed of said upstream ink drum for a period of time necessary for said paper to move from said upstream print position to said downstream print position.

9. A stencil printer as claimed in claim 2, further comprising:

a paper feeding device configured to feed the paper toward said upstream print position;

a paper size sensing device included in said paper feeding device and configured to sense a length of the paper relative to a reference length in the direction of paper conveyance; and a control device configured to interrupt paper feed from said paper feeding device in response to an output of said paper size sensing device representative of the length of the paper greater than the reference length.

10. A stencil printer as claimed in claim 2, further comprising:

a paper size recognizing device positioned on a paper transport path and configured to recognize a length of the paper being conveyed in the direction of paper conveyance; and a control device configured to interrupt, when the length of the paper recognized by said paper size recognizing device is greater than the paper conveyance distance, at least one of paper feed from said paper feeding device and printing after the paper recognized by said paper size recognizing device has been driven out of said stencil printer.

11. A stencil printer as claimed in claim 2, further comprising:

a paper sensing device configured to sense the length of the paper in the direction of paper conveyance;

a moving device configured to move at least one of said intermediate conveyor and said guide member in a direction in which the paper conveyance distance increases; and a control device configured to operate said moving device in accordance with an output of said paper sensing device.

12. A stencil printer as claimed in claim 11, wherein said moving device is selectively movable to a first position where at least one of said intermediate conveyor and said guide member defines a reference paper conveyance distance and a second position where said reference paper conveyance distance increases, said control device causing, when the output of said paper sensing device shows that the length of the paper is greater than said reference paper conveyance distance, said moving device to move at least one of said intermediate conveyor and said guide member to said second position.

13. A stencil printer as claimed in claim 2, further comprising:

a paper sensing device configured to sense the length of the paper in the direction of paper conveyance; and a conveyance control selecting device configured to select, when the length of the paper sensed by said paper sensing device is greater than the paper conveyance distance, an acceleration mode in which a conveying speed of said intermediate conveyor is maintained higher than a conveying speed of said upstream ink drum for a period of time necessary for said paper to move from said upstream print position to said downstream print position.

14. A stencil printer as claimed in claim 1, further comprising:

a paper feeding device configured to feed the paper toward said upstream print position;

a paper size sensing device included in said paper feeding device and configured to sense a length of the paper relative to a reference length in the direction of paper conveyance; and a control device configured to interrupt paper feed from said paper feeding device in response to an output of said paper size sensing device representative of the length of the paper greater than the reference length.

15. A stencil printer as claimed in claim 1, further comprising:

a paper size recognizing device positioned on a paper transport path and configured to recognize a length of the paper being conveyed in the direction of paper conveyance; and a control device configured to interrupt, when the length of the paper recognized by said paper size recognizing device is greater than the paper conveyance distance, at least one of paper feed from said paper feeding device and printing after the paper recognized by said paper size recognizing device has been driven out of said stencil printer.

16. A stencil printer as claimed in claim 1, further comprising:

a paper sensing device configured to sense the length of the paper in the direction of paper conveyance;

a moving device configured to move at least one of said intermediate conveyor and said guide member in a direction in which the paper conveyance distance increases; and a control device configured to operate said moving device in accordance with an output of said paper sensing device.

17. A stencil printer as claimed in claim 16, wherein said moving device is selectively movable to a first position where at least one of said intermediate conveyor and said guide member defines a reference paper conveyance distance and a second position where said reference paper conveyance distance increases, said control device causing, when the output of said paper sensing device shows that the length of the paper is greater than said reference paper conveyance distance, said moving device to move at least one of said intermediate conveyor and said guide member to said second position.

18. A stencil printer as claimed in claim 1, further comprising:

a paper sensing device configured to sense the length of the paper in the direction of paper conveyance; and a conveyance control selecting device configured to select, when the length of the paper sensed by said paper sensing device is greater than the paper conveyance distance, an acceleration mode in which a conveying speed of said intermediate conveyor is maintained higher than a conveying speed of said upstream ink drum for a period of time necessary for said paper to move from said upstream print position to said downstream print position.

* * * * *

UNITED STATES PATENT AND TRADEMARK OFFICE

CERTIFICATE OF CORRECTION

PATENT NO. : 6,205,918 B1
DATED : March 27, 2001
INVENTOR(S) : Mituru Takahasi et al.

It is certified that error appears in the above-identified patent and that said Letters Patent is hereby corrected as shown below:

Column 1,
Line 23, delete [-] after "than".

Column 4,
Line 20, change "camper" to -- clamper --; and
Line 23, change "damper" to -- clamper --.

Column 5,
Lines 22, 24, 31, 34 and 35, change "damper" to -- clamper --.

Column 9,
Line 25, delete "di"; and
Line 26, change "stance" to -- distance --.

Column 12,
Line 43, change "form" to -- from --;
Line 48, delete "di"; and
Line 49, change "stance" to -- distance --.

Column 13,
Line 26, change "grater" to -- greater --.

Column 14,
Line 34, change "journal led" to -- journalled --.

Column 15,
Line 5, change "dash and-dots" to -- dash-and-dots --; and
Line 12, change "91 B" to -- 91B --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*